US009973871B2

(12) United States Patent
Koppens et al.

(10) Patent No.: US 9,973,871 B2
(45) Date of Patent: May 15, 2018

(54) BINAURAL AUDIO PROCESSING WITH AN EARLY PART, REVERBERATION, AND SYNCHRONIZATION

(71) Applicant: KONINKLIJKE PHILIPS N.V., Eindhoven (NL)

(72) Inventors: Jeroen Gerardus Henricus Koppens, Nederweert (NL); Arnoldus Werner Johannes Oomen, Eindhoven (NL); Erik Gosuinus Petrus Schuijers, Breda (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 78 days.

(21) Appl. No.: 14/653,866

(22) PCT Filed: Jan. 8, 2014

(86) PCT No.: PCT/IB2014/058126

§ 371 (c)(1),
(2) Date: Jun. 19, 2015

(87) PCT Pub. No.: WO2014/111829

PCT Pub. Date: Jul. 24, 2014

(65) Prior Publication Data

US 2015/0350801 A1 Dec. 3, 2015

Related U.S. Application Data

(60) Provisional application No. 61/753,459, filed on Jan. 17, 2013.

(51) Int. Cl.
*H04R 5/00* (2006.01)
*H04S 1/00* (2006.01)

(52) U.S. Cl.
CPC ..... *H04S 1/007* (2013.01); *H04S 1/005* (2013.01); *H04S 2420/01* (2013.01)

(58) Field of Classification Search
None
See application file for complete search history.

(56) References Cited

U.S. PATENT DOCUMENTS 5,371,799 A 12/1994 Lowe et al.
9,626,976 B2 4/2017 Jung et al.
(Continued)

FOREIGN PATENT DOCUMENTS

WO 9914983 A1 3/1999
WO 2008069595 A1 6/2008

OTHER PUBLICATIONS

Audio, "Call for Proposals on Spatial Audio Coding", International Organization for Standardization, ISO/IEC JTC 1/SCS 29/WG 11, Coding of Moving Pictures and Audio, N6455, XP30013327A, 2004, pp. 1-10.

(Continued)

*Primary Examiner* — Joseph Saunders, Jr.
*Assistant Examiner* — James Mooney

(57) ABSTRACT

An audio renderer comprises a receiver (801) receiving input data comprising early part data indicative of an early part of a head related binaural transfer function; reverberation data indicative of a reverberation part of the transfer function; and a synchronization indication indicative of a time offset between the early part and the reverberation part. An early part circuit (803) generates an audio component by applying a binaural processing to an audio signal where the processing depends on the early part data. A reverberator (807) generates a second audio component by applying a reverberation processing to the audio signal where the reverberation processing depends on the reverberation data. A combiner (809) generates a signal of a binaural stereo (Continued)

signal by combining the two audio components. The relative timing of the audio components is adjusted based on the synchronization indication by a synchronizer (805) which specifically may be a delay.

17 Claims, 14 Drawing Sheets

(56) References Cited

U.S. PATENT DOCUMENTS

| | | | | |
|---|---|---|---|---|
| 2003/0236814 | A1 | 12/2003 | Miyasaka et al. | |
| 2008/0137875 | A1* | 6/2008 | Zong | G10K 15/12 381/63 |
| 2010/0246832 | A1* | 9/2010 | Villemoes | G10L 19/008 381/17 |
| 2012/0057715 | A1* | 3/2012 | Johnston | G10L 19/008 381/63 |
| 2012/0140938 | A1* | 6/2012 | Yoo | G10L 21/02 381/63 |
| 2015/0213807 | A1 | 7/2015 | Breebaart et al. | |

OTHER PUBLICATIONS

Anonymous, ISO Central Secretariat, "Correspondence Form ISO Central Secretariat Transmitting the ISO Policies for Copyright Notification and for Distribution of ISO Documents Electronically for the Preparation of Standards", ISO/IEC JTC 1 N 4564, XP5522585A, 1997, pp. 1-19.

Algazi et al, "Headphone-Based Spatial Sound", IEEE Signal Processing Magazine, vol. 28, No. 1, 2011, pp. 33-42.

Cheng et al, "Introduction to Head-Related Transfer Functions (HRTF's): Representations of HRTF's in Time, Frequency, and Space", Journal Audio Engineering Society, vol. 49, No. 4, Apr. 2001, pp. 1-28.

Breebaart et al, "Spectral and Spatial Parameter Resolution Requirements for Parametric, Filter-Bank-Based HRTF Processing", Journal of Audio Engineering Society, vol. 58, No. 3, 2010, pp. 126-140.

Menzer et al, "Binaural Reverberation Using a Modified JOT Reverberator With Frequency-Dependent Interaural Coherence Matching", 126th Audio Engineering Society Convention, Munich, Germany, 2009, pp. 1-6.

Breebaart et al, "MPEG Surround Binaural Coding Proposal Philips/Vast Audio", 76th MPEG Meeting, No. M13253, 2006, XP030041922, pp. 1-49.

Menzer et al, "Obtaining Binaural Room Impulse Responses From B-Format Impulse Responses Using Frequency-Dependent Coherence Matching", IEEE Transactions on Audio, Speech, and Language Processing, vol. 19, No. 2, 2011, pp. 396-405.

International Standard, ISO/IEC 23003-2, Information Technology—MPEG Audio Technologies, Part 1: MPEG Surround, 2012, pp. 1-7.

International Standard, ISO/IEC 23003-2, Information Technology—MPEG Audio Technologies, Part 2: Spatial Audio Object Coding (SAOC), 2010, pp. 1-10.

Jot, "An Analysis/Synthesis Approach to Real-Time Artificial Reverberation", Proc. ICASSP-92, vol. 2, 1992, pp. 221-224.

Jot et al, "Digital Delay Networks for Designating Artificial Reverberators", 90th AES Convention, 1991, pp. 1-16.

* cited by examiner

BINAURAL AUDIO PROCESSING WITH AN EARLY PART, REVERBERATION, AND SYNCHRONIZATION

CROSS-REFERENCE TO PRIOR APPLICATIONS

This application is the U.S. National Phase application under 35 U.S.C. § 371 of International Application No. PCT/IB2014/058126, filed on Jan. 8, 2014, which claims the benefit of U.S. Provisional Application 61/753,459, filed on Jan. 17, 2013. These applications are hereby incorporated by reference herein.

FIELD OF THE INVENTION

The invention relates to binaural audio processing and in particular, but not exclusively, to communication and processing of head related binaural transfer function data for audio processing applications.

BACKGROUND OF THE INVENTION

Digital encoding of various source signals has become increasingly important over the last decades as digital signal representation and communication increasingly has replaced analogue representation and communication. For example, audio content, such as speech and music, is increasingly based on digital content encoding. Furthermore, audio consumption has increasingly become an enveloping three dimensional experience with e.g. surround sound and home cinema setups becoming prevalent.

Audio encoding formats have been developed to provide increasingly capable, varied and flexible audio services and in particular audio encoding formats supporting spatial audio services have been developed.

Well known audio coding technologies like DTS and Dolby Digital produce a coded multi-channel audio signal that represents the spatial image as a number of channels that are placed around the listener at fixed positions. For a speaker setup which is different from the setup that corresponds to the multi-channel signal, the spatial image will be suboptimal. Also, channel based audio coding systems are typically not able to cope with a different number of speakers.

(ISO/IEC MPEG-D) MPEG Surround provides a multichannel audio coding tool that allows existing mono- or stereo-based coders to be extended to multi-channel audio applications. FIG. 1 illustrates an example of the elements of an MPEG Surround system. Using spatial parameters obtained by analysis of the original multichannel input, an MPEG Surround decoder can recreate the spatial image by a controlled upmix of the mono- or stereo signal to obtain a multichannel output signal.

Since the spatial image of the multi-channel input signal is parameterized, MPEG Surround allows for decoding of the same multi-channel bit-stream by rendering devices that do not use a multichannel speaker setup. An example is virtual surround reproduction on headphones, which is referred to as the MPEG Surround binaural decoding process. In this mode a realistic surround experience can be provided while using regular headphones. Another example is the pruning of higher order multichannel outputs, e.g. 7.1 channels, to lower order setups, e.g. 5.1 channels.

Indeed, the variation and flexibility in the rendering configurations used for rendering spatial sound has increased significantly in recent years with more and more reproduction formats becoming available to the mainstream consumer. This requires a flexible representation of audio. Important steps have been taken with the introduction of the MPEG Surround codec. Nevertheless, audio is still produced and transmitted for a specific loudspeaker setup, e.g. an ITU 5.1 speaker setup. Reproduction over different setups and over non-standard (i.e. flexible or user-defined) speaker setups is not specified. Indeed, there is a desire to make audio encoding and representation increasingly independent of specific predetermined and nominal speaker setups. It is increasingly preferred that flexible adaptation to a wide variety of different speaker setups can be performed at the decoder/rendering side.

In order to provide for a more flexible representation of audio, MPEG standardized a format known as 'Spatial Audio Object Coding' (ISO/IEC MPEG-D SAOC). In contrast to multichannel audio coding systems such as DTS, Dolby Digital and MPEG Surround, SAOC provides efficient coding of individual audio objects rather than audio channels. Whereas in MPEG Surround, each speaker channel can be considered to originate from a different mix of sound objects, SAOC makes individual sound objects available at the decoder side for interactive manipulation as illustrated in FIG. 2. In SAOC, multiple sound objects are coded into a mono or stereo downmix together with parametric data allowing the sound objects to be extracted at the rendering side thereby allowing the individual audio objects to be available for manipulation e.g. by the end-user.

Indeed, similarly to MPEG Surround, SAOC also creates a mono or stereo downmix. In addition, object parameters are calculated and included. At the decoder side, the user may manipulate these parameters to control various features of the individual objects, such as position, level, equalization, or even to apply effects such as reverb. FIG. 3 illustrates an interactive interface that enables the user to control the individual objects contained in an SAOC bitstream. By means of a rendering matrix individual sound objects are mapped onto speaker channels.

SAOC allows a more flexible approach and in particular allows more rendering based adaptability by transmitting audio objects in addition to only reproduction channels. This allows the decoder-side to place the audio objects at arbitrary positions in space, provided that the space is adequately covered by speakers. This way there is no relation between the transmitted audio and the reproduction or rendering setup, hence arbitrary speaker setups can be used. This is advantageous for e.g. home cinema setups in a typical living room, where the speakers are almost never at the intended positions. In SAOC, it is decided at the decoder side where the objects are placed in the sound scene, which is often not desired from an artistic point-of-view. The SAOC standard does provide ways to transmit a default rendering matrix in the bitstream, eliminating the decoder responsibility. However the provided methods rely on either fixed reproduction setups or on unspecified syntax. Thus SAOC does not provide normative means to fully transmit an audio scene independently of the speaker setup. Also, SAOC is not well equipped to the faithful rendering of diffuse signal components. Although there is the possibility to include a so called Multichannel Background Object (MBO) to capture the diffuse sound, this object is tied to one specific speaker configuration.

Another specification for an audio format for 3D audio is being developed by the 3D Audio Alliance (3DAA) which is an industry alliance. 3DAA is dedicated to develop standards for the transmission of 3D audio, that "will facilitate the transition from the current speaker feed paradigm to a flexible object-based approach". In 3DAA, a bitstream format is to be defined that allows the transmission of a legacy multichannel downmix along with individual sound objects. In addition, object positioning data is included. The principle of generating a 3DAA audio stream is illustrated in FIG. 4.

In the 3DAA approach, the sound objects are received separately in the extension stream and these may be extracted from the multi-channel downmix. The resulting multi-channel downmix is rendered together with the individually available objects.

The objects may consist of so called stems. These stems are basically grouped (downmixed) tracks or objects. Hence, an object may consist of multiple sub-objects packed into a stem. In 3DAA, a multichannel reference mix can be transmitted with a selection of audio objects. 3DAA transmits the 3D positional data for each object. The objects can then be extracted using the 3D positional data. Alternatively, the inverse mix-matrix may be transmitted, describing the relation between the objects and the reference mix.

From the description of 3DAA, sound-scene information is likely transmitted by assigning an angle and distance to each object, indicating where the object should be placed relative to e.g. the default forward direction. Thus, positional information is transmitted for each object. This is useful for point-sources but fails to describe wide sources (like e.g. a choir or applause) or diffuse sound fields (such as ambiance). When all point-sources are extracted from the reference mix, an ambient multichannel mix remains. Similar to SAOC, the residual in 3DAA is fixed to a specific speaker setup.

Thus, both the SAOC and 3DAA approaches incorporate the transmission of individual audio objects that can be individually manipulated at the decoder side. A difference between the two approaches is that SAOC provides information on the audio objects by providing parameters characterizing the objects relative to the downmix (i.e. such that the audio objects are generated from the downmix at the decoder side) whereas 3DAA provides audio objects as full and separate audio objects (i.e. that can be generated independently from the downmix at the decoder side). For both approaches, position data may be communicated for the audio objects.

Binaural processing where a spatial experience is created by virtual positioning of sound sources using individual signals for the listener's ears is becoming increasingly widespread. Virtual surround is a method of rendering the sound such that audio sources are perceived as originating from a specific direction, thereby creating the illusion of listening to a physical surround sound setup (e.g. 5.1 speakers) or environment (concert). With an appropriate binaural rendering processing, the signals required at the eardrums in order for the listener to perceive sound from any desired direction can be calculated, and the signals can be rendered such that they provide the desired effect. As illustrated in FIG. 5, these signals are then recreated at the eardrum using either headphones or a crosstalk cancellation method (suitable for rendering over closely spaced speakers).

Next to the direct rendering of FIG. 5, specific technologies that can be used to render virtual surround include MPEG Surround and Spatial Audio Object Coding, as well as the upcoming work item on 3D Audio in MPEG. These technologies provide for a computationally efficient virtual surround rendering.

The binaural rendering is based on head related binaural transfer functions which vary from person to person due to the acoustic properties of the head, ears and reflective surfaces, such as the shoulders. For example, binaural filters can be used to create a binaural recording simulating multiple sources at various locations. This can be realized by convolving each sound source with the pair of Head Related Impulse Responses (HRIRs) that correspond to the position of the sound source.

By measuring e.g. the responses from a sound source at a specific location in 2D or 3D space at microphones placed in or near the human ears, the appropriate binaural filters can be determined. Typically such measurements are made e.g. using models of human heads, or indeed in some cases the measurements may be made by attaching microphones close to the eardrums of a person. The binaural filters can be used to create a binaural recording simulating multiple sources at various locations. This can be realized e.g. by convolving each sound source with the pair of measured impulse responses for a desired position of the sound source. In order to create the illusion that a sound source is moved around the listener, a large number of binaural filters is required with adequate spatial resolution, e.g. 10 degrees.

The head related binaural transfer functions may be represented e.g. as Head Related Impulse Responses (HRIR), or equivalently as Head Related Transfer Functions (HRTFs) or, Binaural Room Impulse Responses (BRIRs), or Binaural Room Transfer Functions (BRTFs). The (e.g. estimated or assumed) transfer function from a given position to the listener's ears (or eardrums) is known as a head related binaural transfer function. This function may for example be given in the frequency domain in which case it is typically referred to as an HRTF or BRTF, or in the time domain in which case it is typically referred to as a HRIR or BRIR. In some scenarios, the head related binaural transfer functions are determined to include aspects or properties of the acoustic environment and specifically of the room in which the measurements are made, whereas in other examples only the user characteristics are considered. Examples of the first type of functions are the BRIRs and BRTFs.

It is in many scenarios desirable to allow for communication and distribution of parameters for a desired binaural rendering, such as the specific head related binaural transfer functions that are to be used.

The Audio Engineering Society (AES) sc-02 technical committee has recently announced the start of a new project on the standardization of a file format to exchange binaural listening parameters in the form of head related binaural transfer functions. The format will be scalable to match the available rendering process. The format will be designed to include source materials from different head related binaural transfer function databases. A challenge exists in how such head related binaural transfer functions can be best supported, used and distributed in an audio system.

Accordingly, an improved approach for supporting binaural processing, and especially for communicating data for binaural rendering would be desired. In particular, an approach allowing improved representation and communication of binaural rendering data, reduced data rate, reduced overhead, facilitated implementation, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an apparatus for processing an audio signal, the apparatus comprising: a receiver for receiving input data, the input data comprising at least data describing a head related binaural transfer function comprising an early part and a reverberation part, the data comprising: early part data indicative of the early part of the head related binaural transfer function, reverberation data indicative of the reverberation part of the head related binaural transfer function, a synchronization indication indicative of a time offset between the early part and the reverberation part; an early part circuit for generating a first audio component by applying a binaural processing to an audio signal, the binaural processing being at least partly determined by the early part data; a reverberator for generating a second audio component by applying a reverberation processing to the audio signal, the reverberation processing being at least partly determined by the reverberation data; a combiner for generating at least a first ear signal of a binaural signal, the combiner being arranged to combine the first audio component and the second audio component; and a synchronizer for synchronizing the first audio component and the second audio component in response to the synchronization indication.

The invention may provide a particularly efficient operation. A very efficient representation of, and/or processing based on, a head related binaural transfer function can be achieved. The approach may result in reduced data rates and/or reduced complexity processing and/or binaural rendering.

Indeed, rather than using a simple long representation of a head related binaural transfer function resulting in a high data rate and complex processing, the head related binaural transfer function may be divided into at least two parts. The representation and processing may be individually optimized for the characteristics of separate parts of the head related binaural transfer function. In particular, the representation and processing may be optimized for the individual physical characteristics determining the head related binaural transfer function in the individual parts, and/or to the perceptual characteristics associated with each of the parts.

For example, the representation and/or processing of the early part may be optimized for a direct audio propagation path whereas the representation and/or processing of the reverberation path may be optimized for reflected audio propagation paths.

The approach may furthermore provide improved audio quality by allowing the synchronization of the rendering of the different parts to be controlled from the encoder side. This allows the relative timing between the early part and the reverberation part to be closely controlled to provide an overall effect that corresponds to the original head related binaural transfer function. Indeed, it allows for the synchronization of the different parts to be controlled on the basis of information about the full head related binaural transfer function information. In particular, the timing of reflections and diffuse reverberations relative to a direct path depends on e.g. the position of the sound source and the listening position, as well as on the specific room characteristics. This information is reflected in the measured head related binaural transfer function but is typically not available to the binaural renderer. However, the approach allows the renderer to accurately emulate the original measured head related binaural transfer function despite this being represented by two different parts.

The head related binaural transfer function may specifically be a room related transfer function, such as a BRIR or a BRTF.

The synchronizer may specifically be arranged to time align the first and second audio component with a time alignment offset being determined from the synchronization indication.

The synchronizer may synchronize the first audio component and the second audio component in any suitable way. Thus, any approach may be used to adjust the timing of the first audio component relative to the second audio component prior to combining, where the timing adjustment is determined in response to the synchronization indication. For example, a delay may be applied to one of the audio components and/or delays may e.g. be applied to signals from which the first and/or second audio components are generated.

The early part may correspond to a time interval of an impulse response of the head related binaural transfer function prior to a given time instant, and the reverberation part may correspond to a time interval of the impulse response of the head related binaural transfer function after a given time instant (where the two time instants may be, but do not have to be, the same time instant). At least some of the impulse response time interval for the reverberation part is later than the impulse response time interval for the early part. In most embodiments and scenarios, the start of the reverberation part is later than the start of the early part. In some embodiments, the impulse response time interval for the reverberation part is the time interval after a given time (of the impulse response) and the impulse response time interval for the early part is the time interval prior to the given time.

The early part may in some scenarios correspond to, or include, the part of the head related binaural transfer function that corresponds to the direct path from the (virtual) sound source position of the head related binaural transfer function to the (nominal) listening position. In some embodiments or scenarios, the early part may include the part of the head related binaural transfer function that corresponds to one or more early reflections from the (virtual) sound source position of the head related binaural transfer function to the (nominal) listening position.

The reverberation part may in some scenarios correspond to, or include, the part of the head related binaural transfer function that corresponds to the diffuse reverberation in the audio environment represented by the head related binaural transfer function. In some embodiments or scenarios, the reverberation part may include the part of the head related binaural transfer function that corresponds to one or more early reflections from the (virtual) sound source position of the head related binaural transfer function to the (nominal) listening position. Thus, the early reflections may be distributed over the early part and reverberation part.

In many embodiments and scenarios, the early part may correspond to the part of the head related binaural transfer function that corresponds to the direct path from the (virtual) sound source position of the head related binaural transfer function to the (nominal) listening position, and the reverberation part may correspond to the part of the head related binaural transfer function that corresponds to early reflections and diffuse reverberation.

The early part data may be indicative of the early part of the head related binaural transfer function by comprising data which at least partly describes the early part of the head related binaural transfer function. Specifically, it may comprise data which (directly or indirectly) at least describes the head related binaural transfer function in an early time interval. E.g. the impulse response of the head related binaural transfer function in the early time interval may be at least partly described by the data of the early part data.

The reverberation part data may be indicative of the reverberation part of the head related binaural transfer function by comprising data which at least partly describes the reverberation part of the head related binaural transfer function. Specifically, it may comprise data which (directly or indirectly) at least describes the head related binaural transfer function in a reverberation time interval. E.g. the impulse response of the head related binaural transfer function in the reverberation time interval may be at least partly described by the data of the early part data. The reverberation time interval ends after the early time interval, and in many embodiments also begins after the end of the early time interval.

The first audio component may be generated to correspond to the audio signal filtered by the early part of the head related binaural transfer function as this function is described by the early part data.

The second audio component may correspond to a reverberation signal component in the time interval corresponding to the reverberation part, the reverberation signal component being generated from the audio signal in accordance with a process described (at least partly) by the reverberation data.

The binaural processing may correspond to a filtering of the audio signal by a filter corresponding to the head related binaural transfer function in the early part as the function is determined by the early part data.

The binaural processing may generate the first audio component for one signal out of a binaural stereo signal (i.e. it may generate an audio component for the signal of one of the ears).

The reverberation process may be a synthetic reverberator process generating a reverberation signal in the reverberation part from the audio signal in accordance with a process determined from the reverberation data.

The reverberation process may correspond to the audio signal filtered by a reverberation part of the head related binaural transfer function as the function is described by the reverberation part data.

In accordance with an optional feature of the invention, the synchronizer is arranged to introduce a delay for the second audio component relative to the first audio component, the delay being dependent on the synchronization indication.

This may allow low complexity and efficient operation.

In accordance with an optional feature of the invention, the early part data is indicative of an anechoic part of the head related binaural transfer function.

This may result in a particular advantageous operation, and typically a highly efficient representation and processing.

In accordance with an optional feature of the invention, the early part data comprises frequency domain filter parameters, and the early part processing is a frequency domain processing.

This may result in a particular advantageous operation, and typically in a highly efficient representation and processing. In particular, the frequency domain filtering may allow a very accurate emulation of direct path audio propagation with low complexity and resource usage. Furthermore, this can be achieved without requiring the reverberation to also be represented by a frequency domain filtering which would require a high degree of complexity.

In accordance with an optional feature of the invention, the reverberation part data comprises parameters for a reverberation model, and the reverberator is arranged to implement the reverberation model using parameters indicated by the reverberation part data.

This may result in a particular advantageous operation, and typically in a highly efficient representation and processing. In particular, the reverberation modeling may allow a very accurate emulation of reflected audio distribution with low complexity and resource usage. Furthermore, this can be achieved without requiring the direct audio paths to also be represented by the same model.

In accordance with an optional feature of the invention, the reverberator comprises a synthetic reverberator, and the reverberation part data comprises parameters for the synthetic reverberator.

This may result in a particular advantageous operation, and typically in a highly efficient representation and processing. In particular, the synthetic reverberator may allow a very accurate emulation of reflected audio distribution with low complexity and resource usage, while still allowing an accurate representation of the direct audio paths.

In accordance with an optional feature of the invention, the reverberator comprises a reverberation filter, and the reverberation data comprises parameters for the reverberation filter.

This may result in a particular advantageous operation, and typically in a highly efficient representation and processing.

In accordance with an optional feature of the invention, the head related binaural transfer function further comprises an early reflection part between the early part and the reverberation part; and the data further comprises: early reflection part data indicative of the early reflection part of the head related binaural transfer function; and a second synchronization indication indicative of a time offset between the early reflection part and at least one of the early part and the reverberation part; and the apparatus further comprises: an early reflection part processor for generating a third audio component by applying a reflection processing to an audio signal, the reflection processing being at least partly determined by the early reflection part data; and the combiner is arranged to generate the first ear signal of the binaural signal in response to a combination of at least the first audio component, the second audio component, and the third audio component; and the synchronizer is arranged to synchronize the third audio component with at least one of the first audio component and the second audio component in response to the second synchronization indication.

This may result in improved audio quality and/or a more efficient representation and/or processing.

In accordance with an optional feature of the invention, the reverberator is arranged to generate the second audio component in response to a reverberation process applied to the first audio component.

This may provide a particularly advantageous implementation in some embodiments and scenarios.

In accordance with an optional feature of the invention, the synchronization indication is compensated for a processing delay of the binaural processing.

This may provide a particularly advantageous operation in some embodiments and scenarios.

In accordance with an optional feature of the invention, the synchronization indication is compensated for a processing delay of the reverberation processing.

This may provide a particularly advantageous operation in some embodiments and scenarios.

According to an aspect of the invention there is provided an apparatus for generating a bitstream, the apparatus comprising:

a processor for receiving a head related binaural transfer function comprising an early part and a reverberation part; an early part circuit for generating early part data indicative of the early part of the head related binaural transfer function; a reverberation circuit for generating reverberation data indicative of the reverberation part of the head related binaural transfer function; a synchronization circuit for generating synchronization data comprising a synchronization indication indicative of a time offset between the early part data and the reverberation data; and an output circuit for generating a bitstream comprising the early part data, the reverberation data and the synchronization data.

According to an aspect of the invention there is provided a method of processing an audio signal, the method comprising: receiving input data, the input data comprising at least data describing a head related binaural transfer function comprising an early part and a reverberation part, the data comprising: early part data indicative of the early part of the head related binaural transfer function, reverberation data indicative of the reverberation part of the head related binaural transfer function, a synchronization indication indicative of a time offset between the early part and the reverberation part; generating a first audio component by applying a binaural processing to an audio signal, the binaural processing being at least partly determined by the early part data; generating a second audio component by applying a reverberation processing to the audio signal, the reverberation processing being at least partly determined by the reverberation data; generating at least a first ear signal of a binaural signal in response to a combination of the first audio component and the second audio component; and synchronizing the first audio component and the second audio component in response to the synchronization indication.

According to an aspect of the invention there is provided a method of generating a bitstream, the method comprising: receiving a head related binaural transfer function comprising an early part and a reverberation part; generating early part data indicative of the early part of the head related binaural transfer function; generating reverberation data indicative of the reverberation part of the head related binaural transfer function; generating synchronization data comprising a synchronization indication indicative of a time offset between the early part data and the reverberation data; and generating a bitstream comprising the early part data, the reverberation data and the synchronization data.

According to an aspect of the invention there is provided a bitstream comprising data representing a head related binaural transfer function comprising an early part and a reverberation part, the data comprising: early part data indicative of the early part of the head related binaural transfer function; reverberation data indicative of the reverberation part of the head related binaural transfer function; synchronization data comprising a synchronization indication indicative of a time offset between the early part data and the reverberation data.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Binaural rendering wherein virtual positions of sound sources can be emulated by generating individual sound for the two ears of a listener typically generate the position perception based on head related binaural transfer functions. The head related binaural transfer functions are typically determined by measurements wherein the sound is captured at positions close to the eardrum of a human, or a model of a human. Head related binaural transfer functions include HRTFs, BRTFs, HRIRs and BRIRs.

More information on specific representations of head related binaural transfer functions may for example be found in:

"Algazi, V. R., Duda, R. O. (2011). "Headphone-Based Spatial Sound", IEEE Signal Processing Magazine, Vol: 28(1), 2011, Page: 33-42", which describes concepts of HRIR, BRIR, HRTF, BRTFs.

"Cheng, C., Wakefield, G. H., "Introduction to Head-Related Transfer Functions (HRTFs): Representations of HRTFs in Time, Frequency, and Space", Journal Audio Engineering Society, Vol: 49, No. 4, April 2001.", which describes different binaural transfer function representations (in time and frequency).

"Breebaart, J., Nater, F., Kohlrausch, A. (2010). "Spectral and spatial parameter resolution requirements for parametric, filter-bank-based HRTF processing" J. Audio Eng. Soc., 58 No 3, p. 126-140.", which references a parametric representation of HRTF data (as used in MPEG Surround/SAOC).

Figure 1:
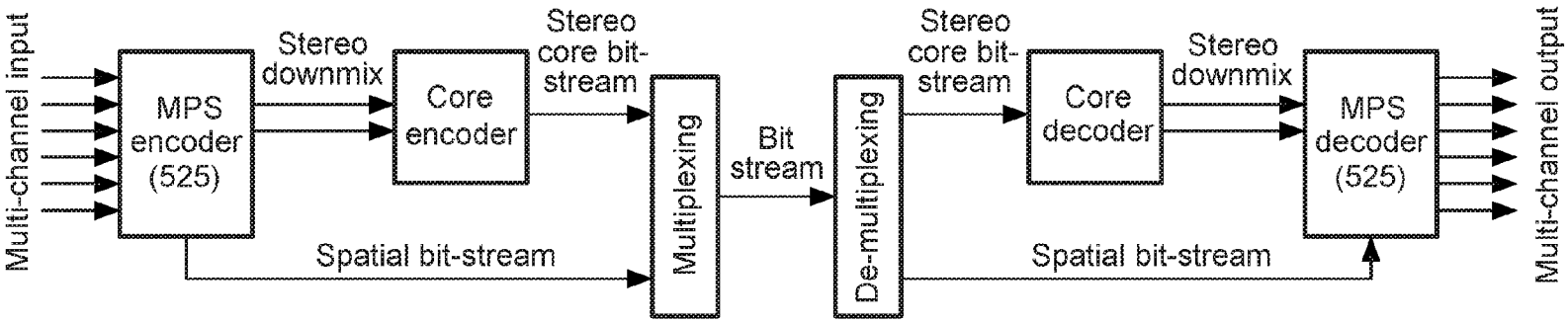
FIG. 1 illustrates an example of elements of an MPEG Surround system.
Figure 2:
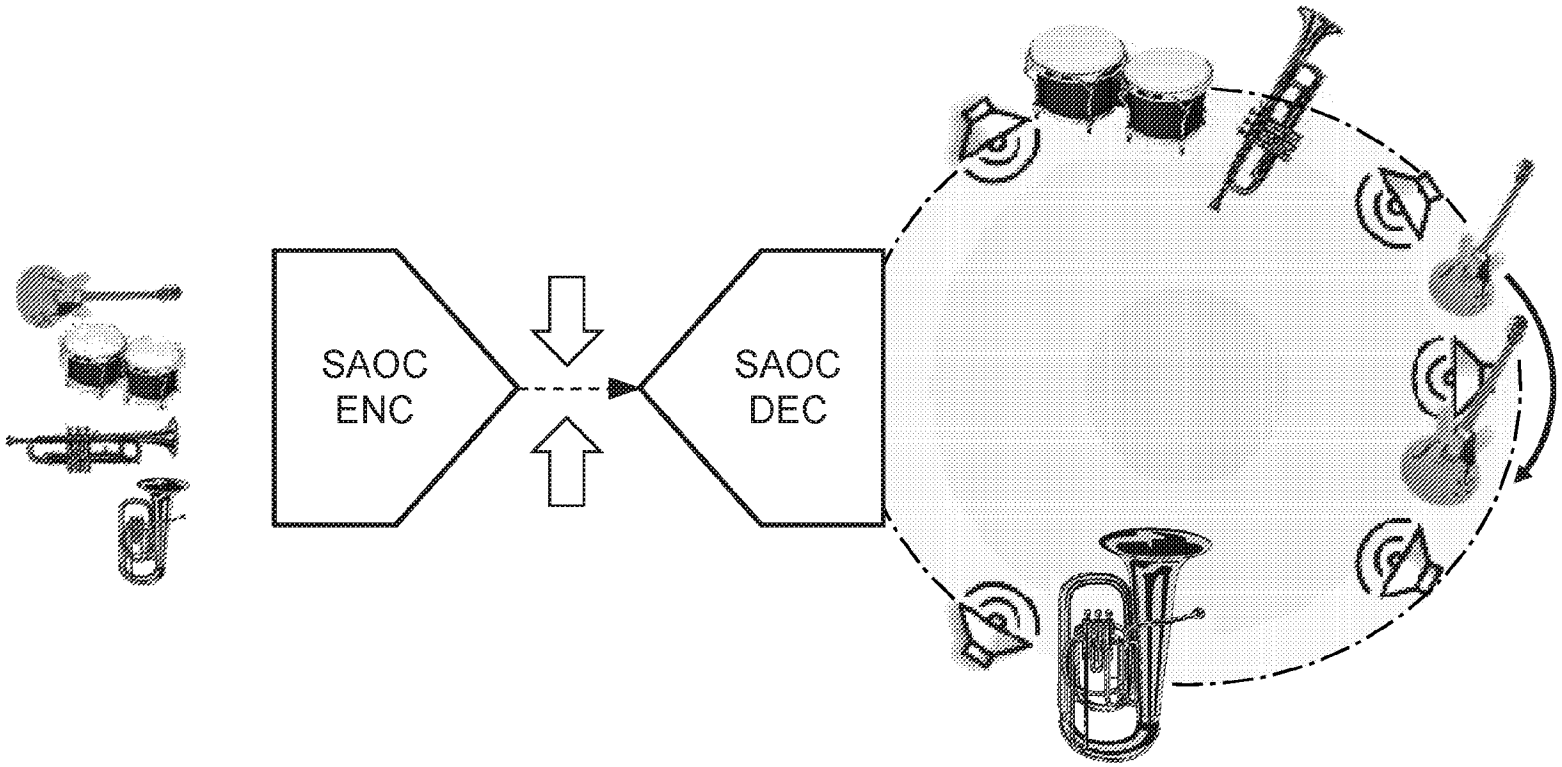
FIG. 2 exemplifies the manipulation of audio objects possible in MPEG SAOC.
Figure 3:
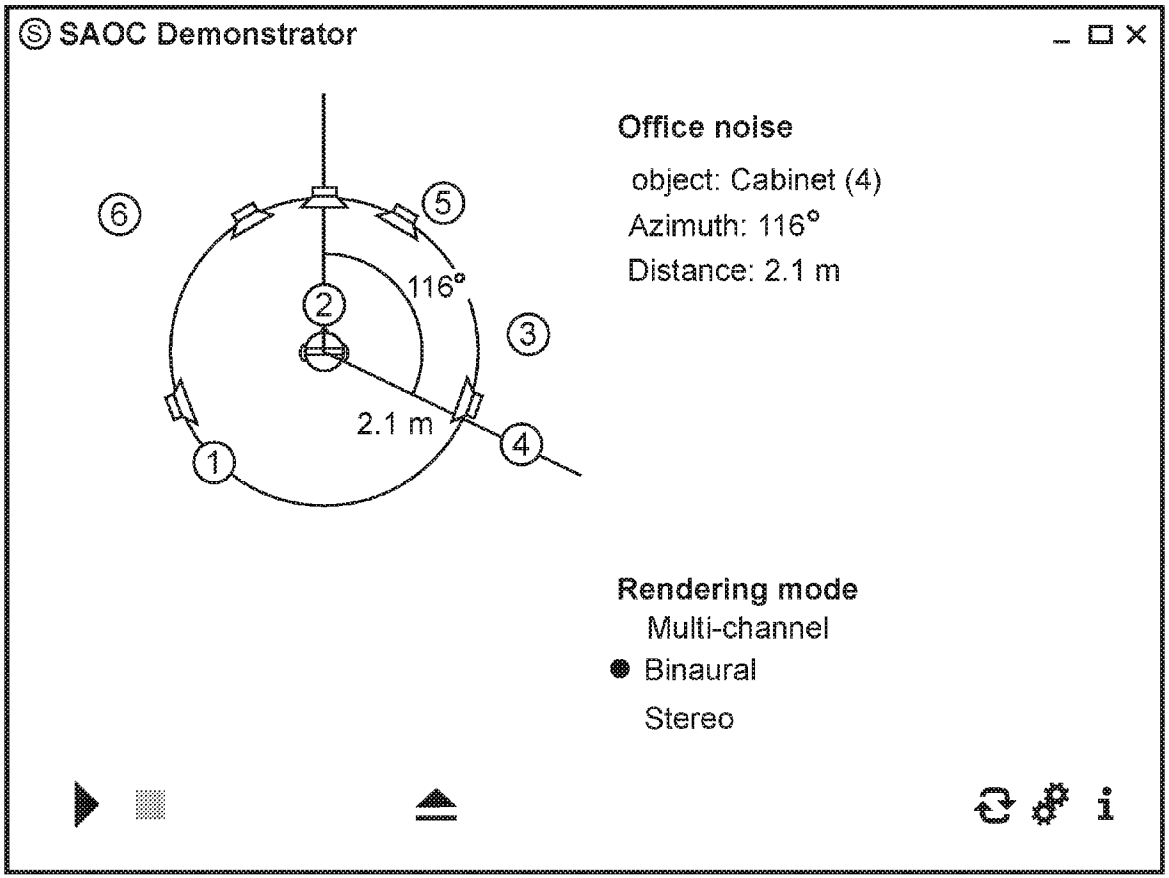
FIG. 3 illustrates an interactive interface that enables the user to control the individual objects contained in an SAOC bitstream.
Figure 4:
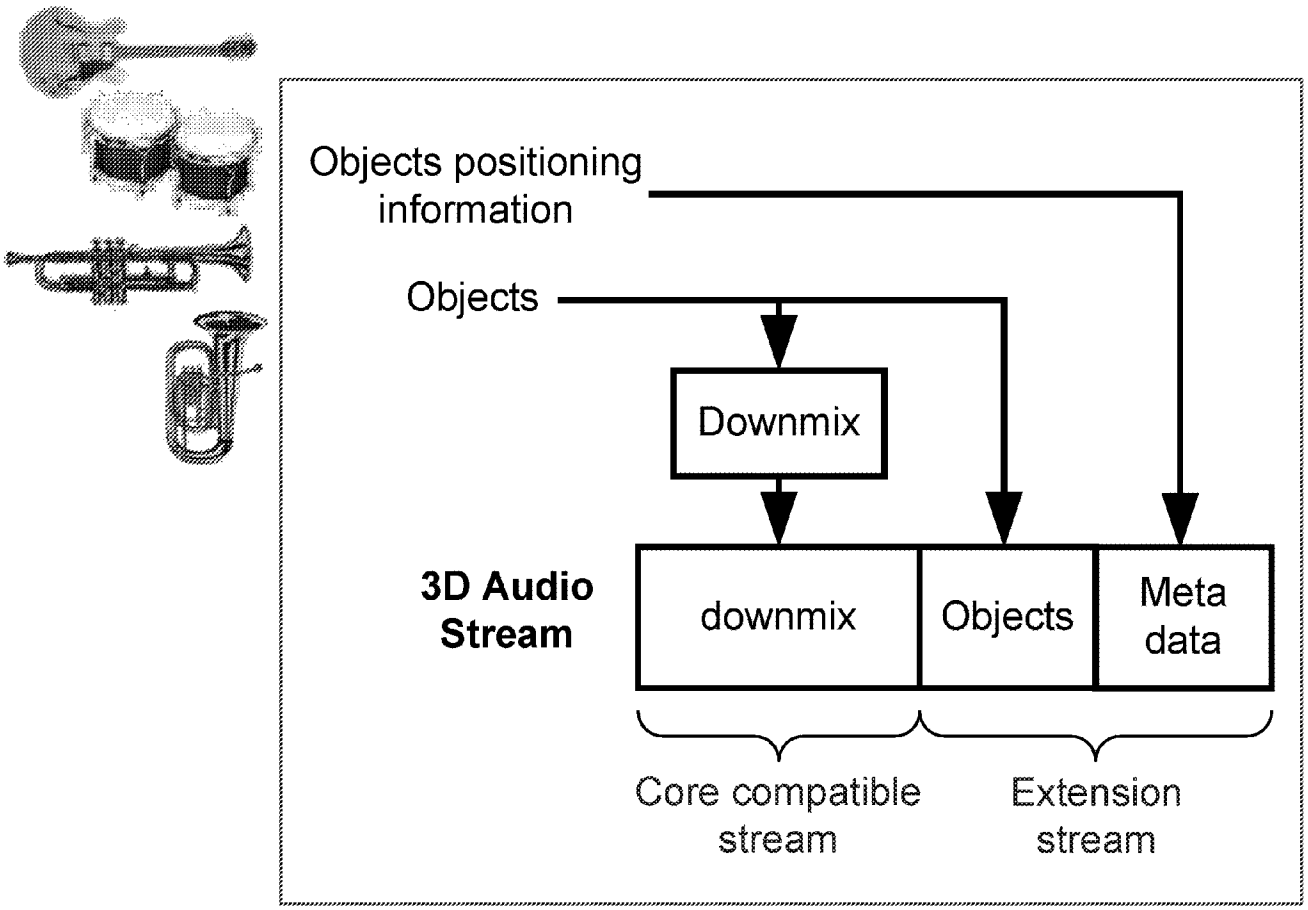
FIG. 4 illustrates an example of the principle of audio encoding of 3DAA.
Figure 5:
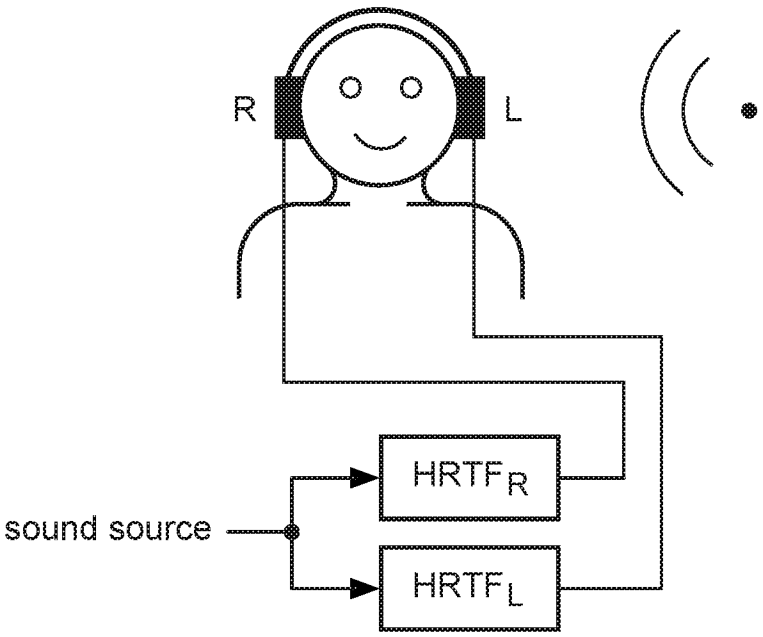
FIG. 5 illustrates an example of binaural processing.
Figure 6:
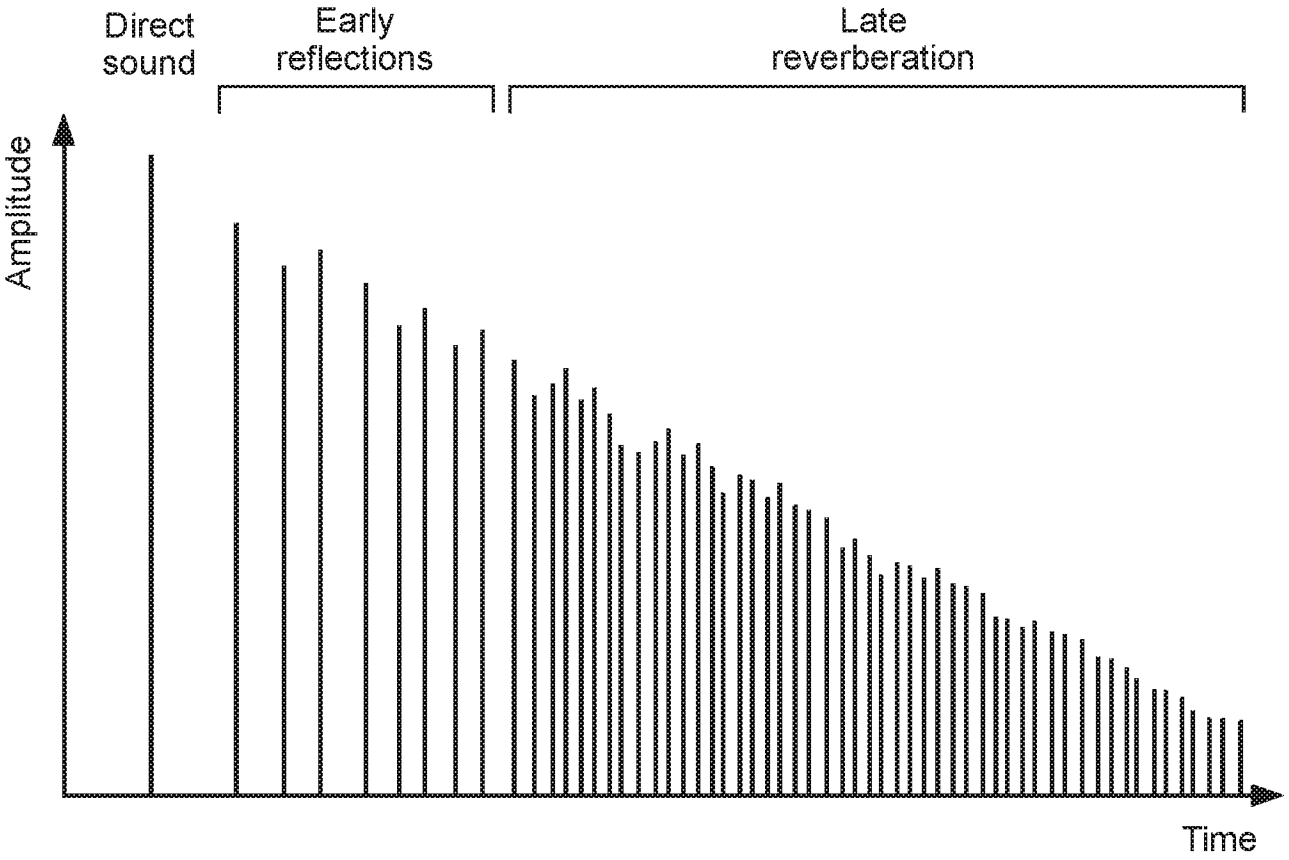
FIG. 6 illustrates an example of a Binaural Room Impulse Response.

An example schematic representation of a head related binaural transfer function for one ear, and specifically of a room related transfer function, is shown in FIG. 6. The example specifically illustrates a BRIR.

The binaural processing to generate a spatial perception from e.g. headphones typically includes a filtering of the audio signal by the head related binaural transfer functions that correspond to the desired position. In order to perform such processing, the binaural renderer accordingly requires knowledge of the head related binaural transfer function.

It is therefore desirable to be able to communicate and distribute head related binaural transfer function information efficiently. However, one challenge arises from the fact that the head related binaural transfer functions may typically be relatively long. Indeed, practical head related binaural transfer function may for example be up to more than 5000 samples at a typical sample rate of 48 kHz. This is particularly significant for highly reverberant acoustic environments, e.g. the BRIR will need to have a significant duration in order to capture the full reverberation tail of such acoustic environments. This results in a high data rate when communicating the head related binaural transfer function.

Furthermore, the relatively long head related binaural transfer functions also result in increased complexity and resource demand of the binaural rendering processing. For example, convolution with long impulse responses may be necessary resulting in a substantial increase in the number of calculations required for each sample. Also, flexibility is reduced as only the specific acoustic environment captured by the head related binaural transfer function is easily reproduced.

Although these issues can be mitigated by truncating the head related binaural transfer function, this will have a substantial impact on the perceived sound. Indeed, the reverberation effects have significant impact on the perceived audio experience and a truncation will therefore typically have significant perceptual impact.

The reverberant portion contains cues that give the human auditory perception information about the distance between the source and the listener (i.e. the position where the BRIRs were measured) and about the size and acoustical properties of the room. The energy of the reverberant portion in relation to that of the anechoic portion largely determines the perceived distance of the sound source. The temporal density of the (early-) reflections contributes to the perceived size of the room.

A head related binaural transfer function can be separated into different parts. Specifically, the head related binaural transfer function initially includes a contribution from the direct propagation path from the sound source position to the microphone (eardrum). This contribution corresponding to the direct sound inherently represents the shortest distance from the sound source to the microphone and accordingly is the first event in the head related binaural transfer function. This part of the head related binaural transfer function is known as the anechoic part as it represents the direct sound propagation without any reflections.

Following the anechoic part, the head related binaural transfer function corresponds to the early reflections that correspond to reflected sound with the reflections typically being off one or two walls. The first reflections may enter the ears shortly after the direct sound and may be close together with secondary reflections (more than one reflection) following relatively shortly afterwards. In many acoustic environments, it is, especially for transient types of sound, often possible to perceptually distinguish at least some of the first and possibly second reflections. The reflection density increases over time when higher order reflections (e.g. reflections over multiple walls) are introduced. After a while, the separate reflections fuse together into what is known as late or diffuse reverberation. For this late or diffuse reverberation tail, the individual reflections can no longer be distinguished perceptually.

Thus, a head related binaural transfer function includes an anechoic component corresponding to a direct (non-reflected) sound propagation path. The remaining (reverberant) portion contains two temporal regions which are usually overlapping. The first region contains the so-called early reflections, which are isolated reflections of the sound source off walls or obstacles inside the room before reaching the ear-drum (or measurement microphone). As the time lag increases, the number of reflections in a fixed time interval increases, and it begins to contain secondary, tertiary etc. reflections. The last region in the reverberant part is the section where these reflections are no longer isolated. This region is often called the diffuse or late reverberation tail.

The head related binaural transfer function may specifically be considered to be made into two parts, namely the early part which includes the anechoic components and the reverberation part which includes the late/diffuse reverberation tails. The early reflections may typically be considered to be part of the reverberation part. However, in some scenarios, one or more of the early reflections may be considered to be part of the early part.

Thus, the head related binaural transfer function may be divided into an early part and a late part (referred to as the reverberation part). E.g. any part of the head related binaural transfer function prior to a given time threshold may be considered part of the early part, and any part of the head related binaural transfer function after the time threshold may be considered to be part of the late/reverberation part. The time threshold may be between the anechoic part and the early reflections. Thus, in some cases, the early part may be identical to the anechoic part, and the reverberation part may include all characteristics arising from reflected sound propagation, including all early reflections. In other embodiments, the time threshold may be such that one or more of the early reflections will be prior to the time threshold, and thus such early reflections will be considered part of the early part of the head related binaural transfer function.

In the following, embodiments of the invention will be described wherein a more efficient representation and/or processing based on head related binaural transfer functions can be achieved. The approach is based on a realization that different parts of the head related binaural transfer function may have different characteristics, and that different parts of the head related binaural transfer function may be treated separately. Indeed, in the embodiments, different parts of the head related binaural transfer function may be processed differently and by different functionality, with the results of the different processes subsequently being combined to generate an output signal which accordingly reflects the impact of the entire head related binaural transfer function.

Specifically, a computational advantage in rendering BRIRs can be obtained in the examples by splitting a BRIR into the anechoic part and the reverberant part (including the early reflections). The shorter filters, necessary to represent the anechoic part can be rendered with a significantly lower computational load than the long BRIR filters. Furthermore, for approaches such as MPEG Surround and SAOC which employ parameterized HRTF reflecting the anechoic part, a very significant reduction in computational complexity can be achieved. Furthermore, the long filters required to represent the reverberation part can be reduced in complexity as the perceptual significance of deviating from the correct underlying head related binaural transfer function is much lower for the reverberation part than for the anechoic part.

Figure 7:
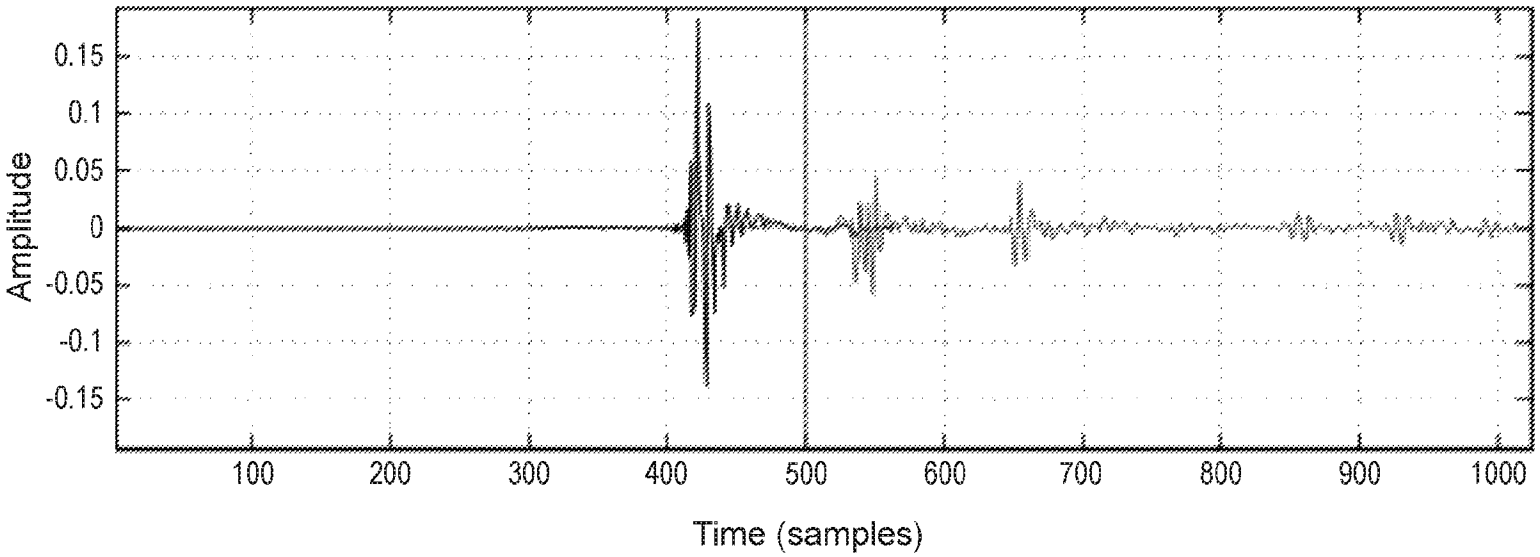
FIG. 7 illustrates an example of a Binaural Room Impulse Response.

FIG. 7 illustrates an example of a measured BRIR. The figure shows the direct response and the first reflections. In the example, the direct response is measured between approximately sample 410 and sample 500. The first reflections start roughly at sample 520, i.e. 120 samples after the direct response. A second reflection occurs approximately 250 samples after the start of the direct response. It can also be seen that the response becomes more diffuse and with less significant individual reflections as time increases.

The BRIR of FIG. 7 may for example be divided into an early part which contains the response prior to sample 500 (i.e. the early part corresponds to the anechoic direct response) and a reverberation part which is made up of the BRIR after sample 500. Thus, the reverberation part includes the early reflections and the diffuse reverberation tail.

In this example, the early part may be represented and processed differently from the reverberation part. For example, a FIR filter may be defined corresponding to the BRIR from sample 410 to 500, and the tap coefficients for this filter may be used to represent the early part of the BRIR. Thus, a FIR filtering may be applied to an audio signal to reflect the impact of the BRIR.

The reverberation part may be represented by different data. For example, it may be represented by a set of parameters for a synthetic reverberator. The rendering may accordingly include the generation of a reverberation signal by applying the synthetic reverberator to the audio signal being processed, where the synthetic reverberator uses the provided parameters. This reverberation representation and processing may be substantially less complex and resource demanding than if a FIR filter with the same accuracy as for the early part was used for the entire BRIR.

The data representing the early part of the head related binaural transfer function/BRIR may for example define an FIR filter which has an impulse response matching the early part of the head related binaural transfer function/BRIR. The data representing the reverberation part of the head related binaural transfer function/BRIR may for example define an IIR filter with an impulse response matching the reverberation part of the head related binaural transfer function/BRIR. As another example, it may provide parameters for a reverberation model which when executed provides a reverberation response that matches the reverberation part of the head related binaural transfer function/BRIR.

The binaural signal may accordingly be generated by combining the two signal components.

Figure 8:
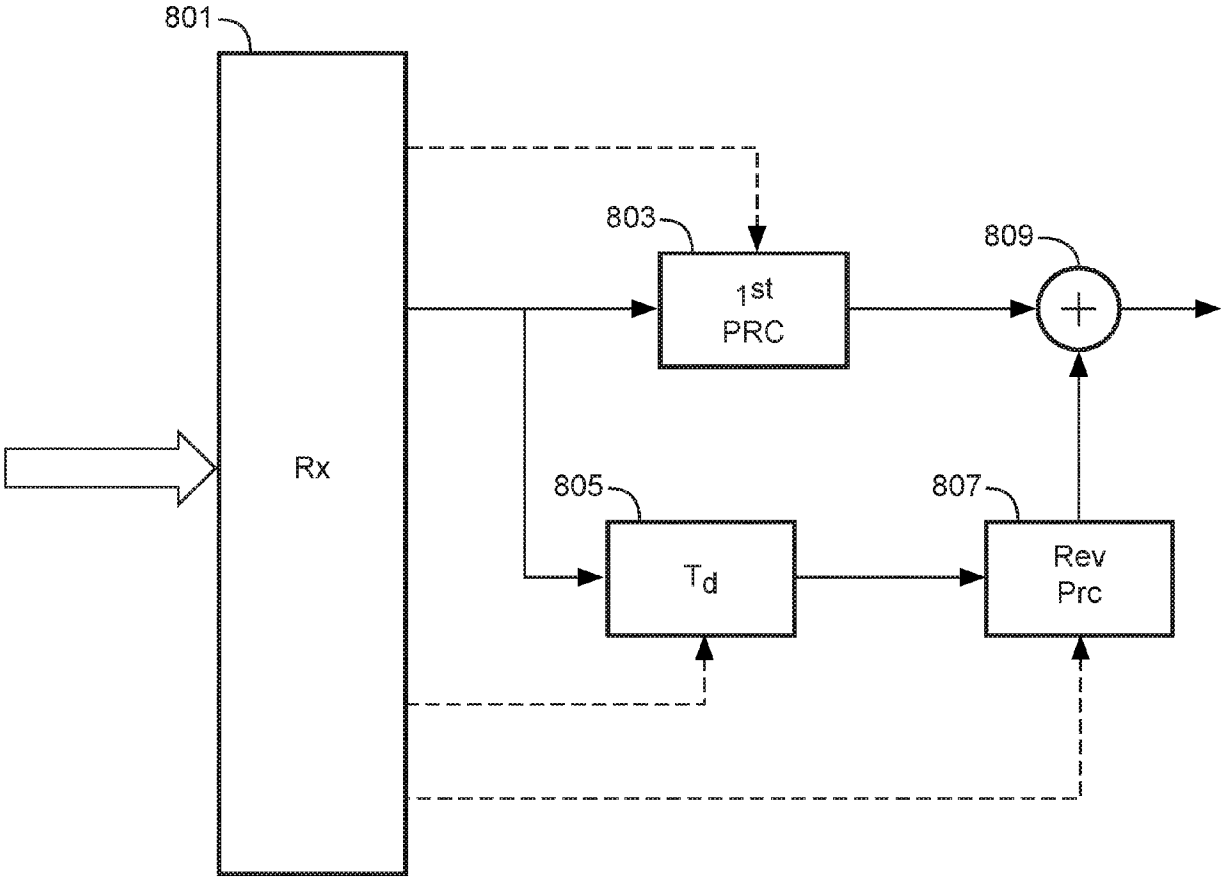
FIG. 8 illustrates an example of a binaural renderer in accordance with some embodiments of the invention.

FIG. 8 illustrates an example of elements of a binaural renderer in accordance with an embodiment of the invention. FIG. 8 specifically illustrates elements used to generate a signal for one ear, i.e. it illustrates the generation of one signal out of the two signals of a binaural signal pair. For convenience, the term binaural signal will be used to refer both to the full binaural stereo signal comprising a signal for each ear and to a signal for only one of the ears of the listener (i.e. to either of the mono signals forming the stereo signal).

The device of FIG. 8 comprises a receiver 801 which receives a bitstream. The bitstream may be received as a real time streaming bitstream, such as e.g. from an Internet streaming service or application. In other scenarios, the bitstream may be received e.g. as a stored data file from a storage medium. The bitstream may be received from any external or internal source and in any suitable format.

The received bitstream specifically comprises data representing a head related binaural transfer function, which in the specific case is a BRIR. Typically, the bitstream will comprise a plurality of head related binaural transfer functions, such as for a range of different positions, but the following description will for clarity and brevity focus on the processing of one head related binaural transfer function. Also, head related binaural transfer functions are typically provided in pairs, i.e. for a given position a head related binaural transfer function is provided for each of the two ears. However, as the following description focuses on the generation of the signal for one ear, the description will also focus on the use of one head related binaural transfer function. It will be appreciated that the same approach as described can also be applied to generate the signal for the other ear by using the head related binaural transfer function for that ear.

The received head related binaural transfer function/BRIR is represented by data which comprises early part data and reverberation data. The early part data is indicative of the early part of the BRIR and the reverberation part is indicative of the reverberation part of the BRIR. In the specific example, the early part consists of to the anechoic part of the BRIR and the reverberation part consists of the early reflections and the reverberation tail. E.g. for the BRIR of FIG. 7, the early part data describes the BRIR up to sample 500 and the reverberation part data describes the BRIR after sample 500. In some embodiments and scenarios, there may be an overlap between the reverberation part and the early part. For example, the early part data may describe the BRIR up to sample 525, and the reverberation part data may describe the BRIR after sample 475.

The descriptions of the two parts of the BRIR are quite different in the specific example. The anechoic part is represented by a relatively short FIR filter whereas the reverberation part is represented by parameters for a synthetic reverberator.

In the specific example, the bitstream furthermore comprises an audio signal which is to be rendered from the position linked to the head related binaural transfer function/BRIR.

The receiver 801 is arranged to process the received bitstream to extract, recover and separate the individual data components of the bitstream such that these can be provided to the appropriate functionality.

The receiver 801 is coupled to an early part circuit in the form of an early part processor 803 which is fed the audio signal. In addition, the early part processor 803 is fed the early part data, i.e. it is fed the data describing the early, and in the specific example, the anechoic, part of the BRIR.

The early part processor 803 is arranged to generate a first audio component by applying a binaural processing to the audio signal where the binaural processing is at least partly determined by the early part data.

Specifically, the audio signal is processed by applying the early part of the head related binaural transfer function to the audio signal thereby generating the first audio component. Thus, the first audio component corresponds to the audio signal as this would be perceived by the direct path, i.e. by the anechoic part of the sound propagation.

The early part data may in the specific example describe a filter corresponding to the early part of the BRIR, and the early part processor 803 may accordingly be arranged to filter the audio signal by a filter corresponding to the early part of the BRIR. The early part data may specifically include data describing the tap coefficients of a FIR filter, and the binaural processing performed by the early part processor 803 may comprise a filtering of the audio signal by the corresponding FIR filter.

The first audio component may accordingly be generated to correspond to the sound which is perceived at the eardrum from the direct path from the desired position.

The receiver 801 is further coupled to a delay 805 which is further coupled to a reverberation processor 807. The reverberation processor 807 is also fed the audio signal via the delay 805. In addition, the reverberation processor 807 is fed the reverberation part data, i.e. it is fed the data describing the reflected sound propagation, and in the specific example describing the early reflections and the diffuse reverberation tails where the individual reflections cannot be separated.

The reverberation processor 807 is arranged to generate a second audio component by applying a reverberation processing to the audio signal where the reverberation processing is at least partly determined by the reverberation data.

Figure 9:
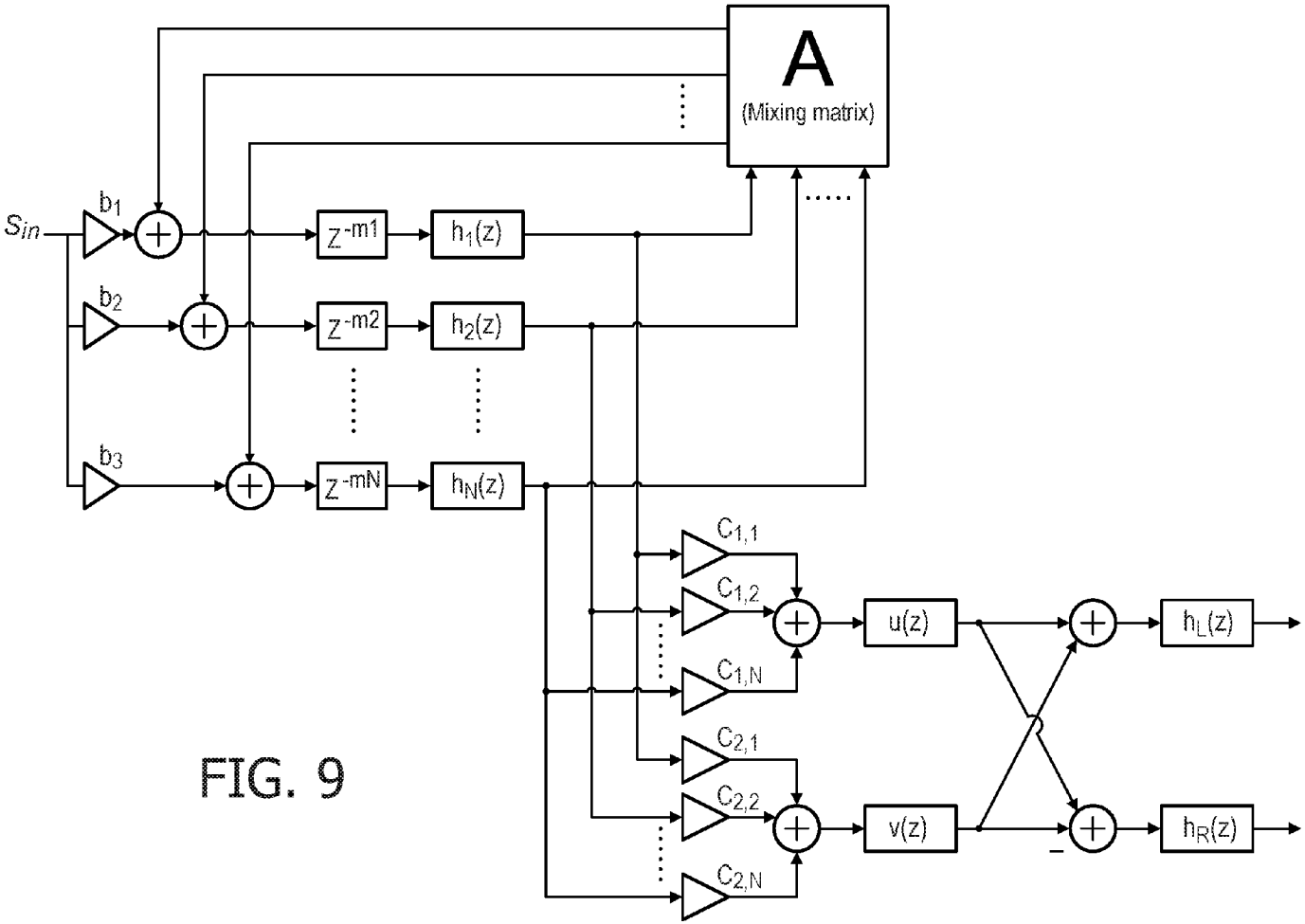
FIG. 9 illustrates an example of a modified Jot reverberator.

In the specific example, the reverberation processor 807 may comprise a synthetic reverberator which generates a reverberation signal based on a reverberation model. A synthetic reverberator typically simulates early reflections and the dense reverberation tail using a feedback network. Filters included in the feedback loops control reverberation time (T60) and coloration. The synthetic reverberator may specifically be a Jot reverberator and FIG. 9 illustrates an example of a schematic depiction of a modified Jot reverberator (with three feedback loops). In the example, the Jot reverberator has been modified to output two signals instead of one such that it can be used for representing binaural reverberations without needing a separate reverberator for each of the binaural signals. Filters have been added to provide control over interaural correlation (u(z) and v(z)) and ear-dependent coloration ($h_L$ and $h_R$).

It will be appreciated that many other synthetic reverberators exist and will be known to the skilled person, and that any suitable synthetic reverberator may be used without detracting from the invention.

The parameters of the synthetic reverberator, such as the mixing matrix coefficients and all or some of the gains for the Jot reverberator of FIG. 9 may be provided by the reverberation part data. Thus, at the encoder side where the full BRIR is available, the parameter sets which results in the closest match between the measured BRIR and the effect of the reverberator may be determined. The resulting parameters are then encoded and included in the reverberation part data of the bitstream.

The reverberation part data is extracted and fed to the reverberation processor 807 in the device of FIG. 8, and the reverberation processor 807 accordingly proceeds to implement the (e.g. Jot) reverberator using the received parameters. When the resulting reverberation model is applied to the audio signal ($S_{in}$ in the example of FIG. 9), a reverberant signal is generated which closely matches that resulting from applying the reverberation part of the BRIR to the audio signal.

Thus, a close approximation to the original effect of the BRIR response is achieved using a low complexity synthetic reverberator which is controlled by the parameters provided in the reverberation part data. The second audio component is thus in the example generated as a reverberation signal resulting from applying a synthetic reverberator to the audio signal. This reverberation signal is generated using a process that requires substantially less processing than for a filter having a correspondingly long impulse response. Thus, substantially reduced computational resource is needed thereby e.g. allowing the process to be performed on low resource devices, such as e.g. portable devices. The generated reverberation signal may in many scenarios not be as accurate a representation as that which would be achieved if a detailed and long BRIR had been used to filter the signal. However, the perceptual impact of such deviations is significantly lower for the reverberation part than for the early part. In most scenarios and embodiments, the deviations result in insignificant changes, and typically a very natural reverberation corresponding to the original reverberation characteristics is achieved.

The early part processor 803 and the reverberation processor 807 are fed to a combiner 809 which generates a first ear signal of the binaural stereo signal by combining the first audio component and the second audio component. It will be appreciated that the combiner 809 may in some embodiments include other processing, such as a filter or level adjustments. Also, the generated combined signal may be amplified, converted to the analog signal domain etc. in order to be fed to e.g. one earphone of a headphone thereby providing sound for one ear of the listener.

The described approach may also be performed in parallel to generate a signal for the other ear of the listener. The same approach may be used but will use the head related binaural transfer function for the other ear of the listener. This other signal may then be fed to the other earphone of the headphone to provide the binaural spatial experience.

In the specific example, the combiner 809 is a simple adder which adds the first audio component and the second audio component to generate the (one ear) binaural signal. However, it will be appreciated that in other embodiments other combiners may be used, such as e.g. a weighted summation, or an overlap-and-add in cases where the reverberation and early parts overlap.

Thus, the binaural signal for one ear is generated by adding two audio components where one audio component corresponds to the anechoic part of the acoustic transfer function from the sound source position to the ear, and the other audio component corresponds to the reflected part of the acoustic transfer function (which is often referred to as the reverberation part. The combined signal may accordingly represent the entire acoustic transfer function/head related binaural transfer function, and in particular may reflect the entire BRIR. However, since the different parts are treated separately, both the data representation and the processing can be optimized for the individual characteristics of the individual part. In particular, a relatively accurate head related binaural transfer function representation and processing may be used for the anechoic part whereas a significantly less accurate but significantly more effective representation and processing can be used for the reverberation part. E.g. a relatively short but accurate FIR filter may be used for the anechoic part and a less accurate but longer response may be employed for the reverberation part by use of a compact reverberation model.

However, the approach also results in some challenges. Specifically, the anechoic signal (the first audio component) and the reverberant signal (the second audio component) will generally have different delays. The processing of the anechoic part by the early part processor 803 will introduce a delay to the generation of the reverberation signal. Similarly, the reverberation process by the reverberation processor 807 will introduce a delay to the reverberation signal. However, the delay introduced by a synthetic reverberator may be lower than the delay introduced by an anechoic FIR filtering.

As a result, the response of the reverb could consequently even occur before the anechoic response in the combined output signal. As such a result is incongruent with the filtering by head, ears and room in any physical situation, this results in a poor performance and in a distorted spatial experience. More generally, the parallel processing with different delays will tend to shift the start of the reverb towards the start of the anechoic response in comparison to the head related binaural transfer function and the underlying acoustic transfer function. In general, if the reflections and diffuse reverb do not have an appropriate delay with respect to the anechoic part, the combined binaural signal may sound unnatural.

To counter this disadvantageous effect, a delay can be introduced in the reverberant signal path which adjusts for the difference in the processing delays of the early part processor 803 and the reverberation processor 807. E.g. if the processing delay of the early part processor 803 (in generating the first audio component/anechoic signal) is denoted $T_b$ and the processing delay of the reverberation processor 807 (in generating the second audio component/reverberation signal) is denoted $T_r$ then a delay of $T_d=T_b-T_r$ may be introduced in the reverberation signal path. However, such a delay is only aimed at compensating for the processing delays and will merely result in the alignment of the first reflection of the reverb with the direct response of the anechoic part. Such an approach would not result in the combined effect corresponding to the desired head related binaural transfer function as the first reflection does not occur at the same time as the anechoic part but some time thereafter. Therefore, such an approach would not correspond to the acoustic properties or the desired head related binaural transfer function. Indeed, the first reflections from the synthetic reverb should occur at a specific delay after the main pulse of the anechoic response. Furthermore, this delay is not merely dependent on the processing delays but is dependent on the position of the source and receiver in the room during the BRIR measurement. Accordingly, the delay is not immediately derivable by the apparatus of FIG. 8.

In the system of FIG. 8, however, the received bitstream also comprises a synchronization indication which is indicative of a time offset between the early part and the reverberation part. Thus, the bitstream can comprise synchronization data which can be used by the receiver to synchronize and time align the first and second audio components (i.e. the anechoic signal and the reverberation signal in the specific example).

The synchronization indication can be based on a suitable time offset, such as the delay between the start of the anechoic part and the start of the first reflection. This information can be determined at the encoding/transmitting side based on the full head related binaural transfer function. For example, when the full BRIR is available, the relative time offset between the start of the anechoic part and the start of the first reflection can be determined as part of the process of dividing the BRIR into the early and reverberation part.

The bitstream thus does not only include separate data for an early processing and a reverberation processing but also includes synchronization information which can be used to synchronize/time align the two audio components by the receiver/renderer.

This is in FIG. 8 implemented by a synchronizer which is arranged to synchronize the first audio component and the second audio based on the synchronization indication. Specifically, the synchronization may be such that the first and second audio components are combined to give a time offset between the onset of the anechoic part and the first reflection corresponding to the time offset indicated by the synchronization indication.

It will be appreciated that such a synchronization may be performed in any suitable way, and indeed need not be performed directly by processing of any of the first and second audio components. Rather, any process which is capable of resulting in a change in the relative timing of the first and second audio components can be used. For example, adjusting a length of the filters at the output of the Jot reverberator may adjust the relative delay.

In the example of FIG. 8, the synchronizer is implemented by the delay 805 which receives the audio signal and provides it to the reverberation processor 807 with a delay that is dependent on the received synchronization indication. The delay 805 is accordingly coupled to the receiver 801 from which it receives the synchronization indication. For example, the synchronization indication may indicate a desired delay, $T_o$, between the onset of the anechoic part and the first reflection. In response the delay 805 can specifically be set such that the total delay of the reverberation path deviates from the delay of the early part path by this amount, i.e. the delay $T_d$ may be set as:

$$T_d=T_b-T_r+T_o.$$

For example, at the transmitter end, the BRIR of FIG. 7 may be analyzed to identify the time offset between the first reflections and the direct response. In the specific example, the first reflection occurs 126 samples after the onset of the direct response, and accordingly a synchronization indication indicating the delay of $T_o=126$ samples may be included in the bitstream. At the receiver end, the device of FIG. 8 will know the relative delays of the early processing, $T_b$, and of the reverberation processing, $T_r$. These may for example be expressed in terms of samples, and the delay of the delay 805 in samples may easily be calculated from the above equation.

In the example above, the synchronization indication directly reflects the desired delay. However, it will be appreciated that in other embodiments, other synchronization indications may be used, and specifically other related delays may be provided.

For example, in some embodiments, the delay/time offset indicated by the synchronization indication may be compensated for at least one of the delays associated with the processing in the receiver. Specifically, the synchronization indication provided in the bitstream may be compensated for at least one of the binaural processing and the reverberation processing.

Thus, in some embodiments, the encoder may be able to determine or estimate the delays that will be incurred by the early part processor 803 and the reverberation processor 807, and rather than a total desired delay, the synchronization indication may indicate a time offset or delay which has been modified dependent on the delay of the early part processing, the reverberation processing or both. Specifically, in some embodiments, the synchronization indication may directly indicate the desired delay of the delay 805 which may automatically be set to this value.

For example, in some embodiments, the anechoic part is represented by a FIR filter of a given length corresponding to a given delay being introduced at by the early part processor 803. Furthermore, a specific implementation of the synthetic reverberator may be specified and accordingly the resulting delay may be known at the transmitter. Thus, in such an embodiment, the generation of the synchronization indication may take these values into account. For example, denoting the estimated, assumed or nominal delay for the early part processing by $T_b$ and the estimated, assumed or nominal delay for the early part processing by $T_r$ the transmitter may generate the synchronization indication to indicate the delay given as:

$$T_d=T_b-T_r+T_o.$$

i.e. to directly indicate the value for the delay 805.

In other embodiments, other delay values may be communicated, such as e.g. the total delay of the reverberation path $T_{comp}=T_b+T_o$.

It will be appreciated that any representation of the synchronization, and in particular the delays, may be used. For example, the delays may be provided in milliseconds, samples, frame units etc.

In the example of FIG. 8, the synchronization of the anechoic audio component and the reverberation component is achieved by delaying the audio signal that is being fed to the reverberation processor 807. However, it will be appreciated that in other embodiments other means of changing the relative time alignment between the anechoic audio component and the reverberation component may be used. As an example, the delay may be applied directly to the reverberation audio component prior to combination (i.e. at the output of the reverberation processor 807). As another example, the variable delay may be introduced in the early part processing path. For example, the reverberation path may implement a fixed delay which is longer than a maximum possible time offset between the onset of the anechoic response and the first reflection. A second variable delay can be introduced in the early part processing path and can be adjusted based on the information in the synchronization indication in order to give the desired relative delay between the two paths.

Figure 10:
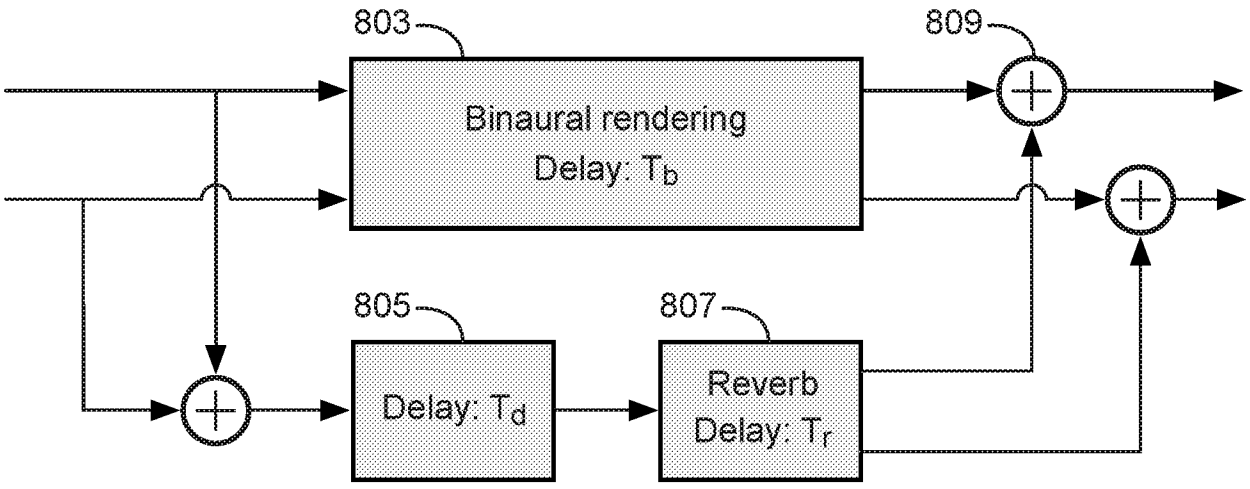
FIG. 10 illustrates an example of a binaural renderer in accordance with some embodiments of the invention.

In the example of FIG. 8, the elements associated with the generation of a signal for one ear of a listener is illustrated. It will be appreciated that the same approach may be used to generate the signal for the other ear. In some embodiments, the same reverberation processing may furthermore be used for both signals. Such an example is illustrated in FIG. 10. In the example, a stereo signal is received which e.g. may be a downmixed MPEG Surround Sound stereo signal. The early part processor 803 performs a binaural processing based on the early part of the BRIR thereby generating a binaural stereo output. Furthermore, a combined signal is generated by combining the two signals of the input stereo input signal and the resulting signal is then delayed by the delay 805, and a reverberation signal is generated from the delayed signal by the reverberation processor 807. The resulting reverberation signal is added to both signals of the stereo binaural signal generated by the early part processor 803.

Thus, in the example, reverberation generated from a combined signal is added to both of the binaural mono signals. The reverberator may generate different reverberation signals for the different signals of the binaural stereo signal. However, in other embodiments, the generated reverberation signals may be the same for both of the signals, and thus the same reverberation may in some embodiments be added to both of the binaural mono signals. This may reduce complexity and is typically acceptable as especially the later reflections and the reverberation tail is less dependent on the difference in position between the ears of the listener.

Figure 11:
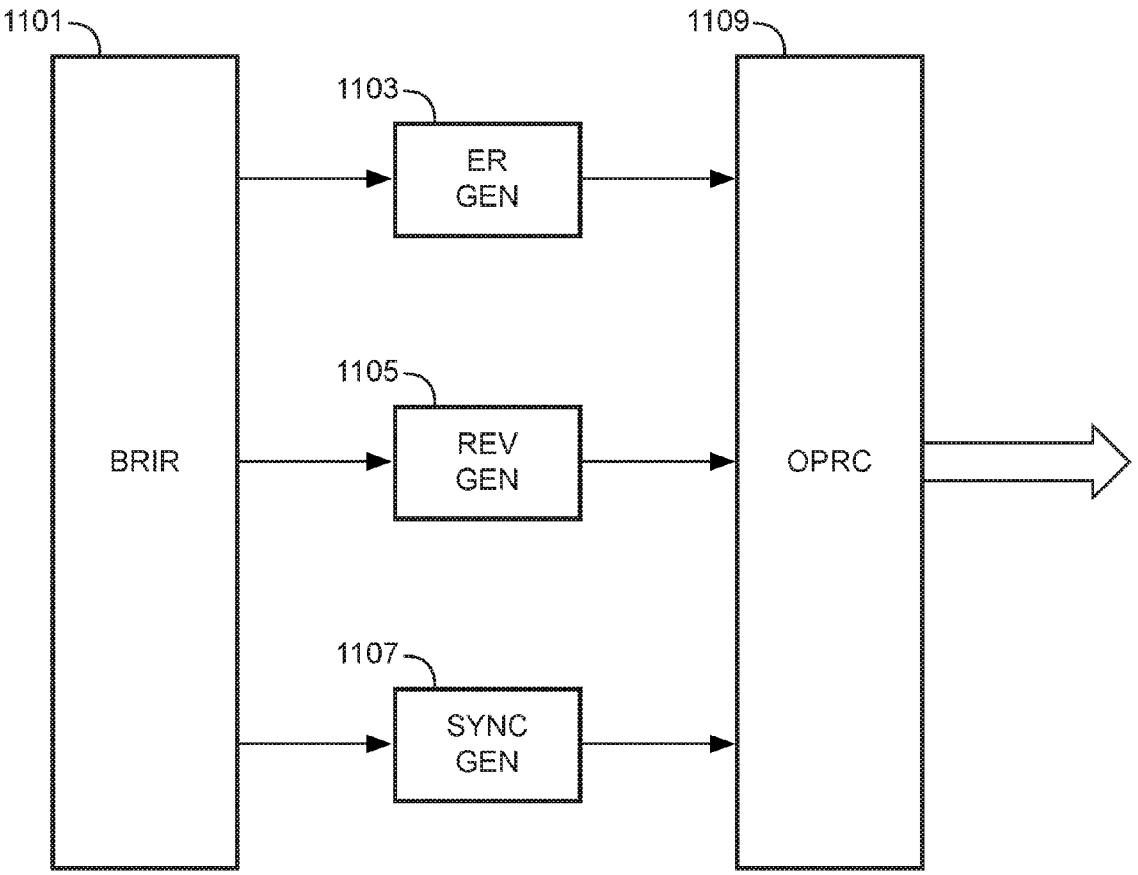
FIG. 11 illustrates an example of a transmitter of head related binaural transfer function data in accordance with some embodiments of the invention.

FIG. 11 illustrates an example of a device for generating and transmitting a bitstream suitable for the receiver device of FIG. 8.

The device comprises a processor/receiver 1101 which receives the head related binaural transfer function that is to be communicated. In the specific example, the head related binaural transfer function is a BRIR, such as e.g. the BRIR of FIG. 7. The receiver 1101 is arranged to divide the BRIR into an early part and a reverberation part. For example, the early part may constitute the part of the BRIR which occurs before a given time/sample instant, and the reverberation part may constitute the part of the BRIR which occurs after the given time/sample instant.

In some embodiments, the division into the early part and the reverberation part is performed in response to a user input. For example, the user may input an indication of a maximum dimension of the room. The time instant dividing the two parts may then be set as the time of the onset of the early response plus the sound propagation time for that distance.

In some embodiments, the division into the early part and the reverberation part may be performed fully automatically and based on the characteristics of the BRIR. For example, the envelope of the BRIR may be calculated. A good division into the early part and reverberation part is then given by finding the first valley after the first (significant) peak of the time envelope.

The early part of the head related binaural transfer function is fed to an early part circuit in the form of an early part data generator 1103 which is coupled to the receiver 1101. The early part data generator 1103 then proceeds to generate early part data describing the early part of the head related binaural transfer function. As an example, the early part data generator 1103 may match an FIR filter of a given length to best fit the early part of the head related binaural transfer function/BRIR. For example, coefficient values may be determined to maximize energy and/or minimize a mean square error between the FIR filter impulse response and the BRIR. The early part data generator 1103 may then generate the early part data as data describing the FIR coefficients. In many embodiments, the FIR filter coefficients may simple be determined as the impulse response sample values, or in many embodiments as a subsampled representation of the impulse response.

In parallel, the reverberation part of the head related binaural transfer function is fed to a reverberation circuit in the form of a reverberation part data generator 1105 which is also coupled to the receiver 1101. The reverberation part data generator 1105 then proceeds to generate reverberation part data describing the reverberation part of the head related binaural transfer function. As an example, the reverberation part data generator 1105 may adjust parameters for a reverberation model, such as the Jot reverberator of FIG. 9, such that the response of the model better matches that of the late part of the BRIR. It will be appreciated that the skilled person will be aware of a number of different approaches for matching a reverberation model to a measured BRIR, and this will for brevity not be described further herein. More information on the Jot reverberator may be found in Menzer, F., Faller, C., "Binaural reverberation using a modified Jot reverberator with frequency-dependent interaural coherence matching", 126th Audio Engineering Society Convention, Munich, Germany, May 7-10 2009". Direct transmission of the filter coefficients of the different filters making up the Jot reverberator may be one way to describe the parameters of the Jot reverberator.

In some embodiments, the reverberation part data generator 1105 may generate coefficient values for a filter having an impulse response corresponding to that of the reverberation part of the BRIR. For example, coefficients of an IIR filter may be adjusted to minimize e.g. a minimum square error between the impulse response of the IIR filter and the reverberation part of the BRIR.

The bitstream generator and transmitter of FIG. 11 further comprises a synchronization circuit in the form of a synchronization indication generator 1107 which is coupled to the receiver 1101. The receiver 1101 may provide timing information relating to the timing of the early part and the reverberation part to the synchronization indication generator 1107 which then proceeds to generate a synchronization indication which is indicative thereof.

For example, the receiver 1101 may provide the BRIR to the synchronization indication generator 1107. The synchronization indication generator 1107 may then analyze the BRIR to determine when the onset of the first response and the first reflection respectively occur. This time difference may then be encoded as the synchronization indication.

The early part data generator 1103, reverberation part data generator 1105 and the synchronization indication generator 1107 are coupled to an output circuit in the form of a bitstream processor 1109 which proceeds to generate a bitstream comprising the early part data, the reverberation part data, and the synchronization indication.

It will be appreciated that any approach for arranging the data in the bitstream may be used. It will also be appreciated that the bitstream is typically generated to comprise data describing a plurality of head related binaural transfer functions, as well as possibly other types of data. In the specific example, the bitstream processor 1109 also receives audio data, including e.g. an audio signal for rendering using the included head related binaural transfer function(s).

The bitstream generated by the bitstream processor 1109 may then be communicated as a real time streaming, be stored as a data file in a storage medium, etc. Specifically, the bitstream may be transmitted to the receiving device of FIG. 8.

An advantage of the described approach is that different representations of the head related binaural transfer function may be used for the early part and for the reverberation part. This may allow the representation to be individually optimized for each individual part.

In many embodiments and for many scenarios, it will be particularly advantageous for the early part data comprises frequency domain filter parameters, and for the early part processing to be a frequency domain processing.

Indeed, the early part of the head related binaural transfer function is typically relatively short and may therefore effectively be implemented by a relatively short filter. Such a filter can often more effectively be implemented in the frequency domain as this requires only multiplication rather than convolution. Thus, by directly providing the values in the frequency domain, an effective and easy to use representation is provided which does not require transformation of this data from or to the time domain by the receiver.

The early part may specifically be represented by a parametric description. A parametric representation may provide a set of frequency domain coefficients for a set of fixed or non-constant frequency intervals, such as e.g. a set or frequency bands according to the Bark scale or ERB scale. As an example, a parametric representation may consist of two level parameters (one for the left ear and one for the right ear) and a phase parameter describing the phase difference between the left and right ear for each frequency band. Such a representation is e.g. employed in MPEG Surround. Other parametric representations may consist of model parameters, e.g. parameters describing a user characteristic, e.g. male female or certain anthropometric features such as the distance between both ears. In this case the model is then able to derive a set of parameters, e.g. the amplitude and phase parameters, merely based on the anthropometric information, In the previous examples, the reverberation data provided parameters for a reverberation model and the reverberation processor 807 was arranged to generate the reverberation signal by implementing this model. However, in other embodiments, other approaches may be used.

For example, in some embodiments, the reverberation processor 807 may implement a reverberation filter which will typically have a longer duration but be less accurate (e.g. with coarser coefficient or time quantization) than a filter used for the early part. In such embodiments, the reverberation part data may comprise parameters for the reverberation filter, such as specifically frequency or time domain coefficients for implementing the filter.

E.g. the reverberation data may be generated as an FIR filter with relatively low sample rate. The FIR filter may provide the best match possible for the head related binaural transfer function for this reduced sample rate. The resulting coefficients may then be encoded in the reverberation part data. At the receiving end, the corresponding FIR filter may be generated and may e.g. be applied to the audio signal at the lower sample rate. In this example, the early part processing and the reverberation part processing may be performed at different sample rates, and e.g. the reverberation processing part may comprise a decimation of the input audio signal and an upsampling of the resulting reverberation signal. As another example, an FIR filter for the higher sample rate may be generated by generating additional FIR coefficients by interpolation of the reduced rate FIR coefficients received as part of the reverberation data.

An advantage of the approach is that it may be used together with the newer audio encoding standards such as MPEG Surround and SAOC.

Figure 12:
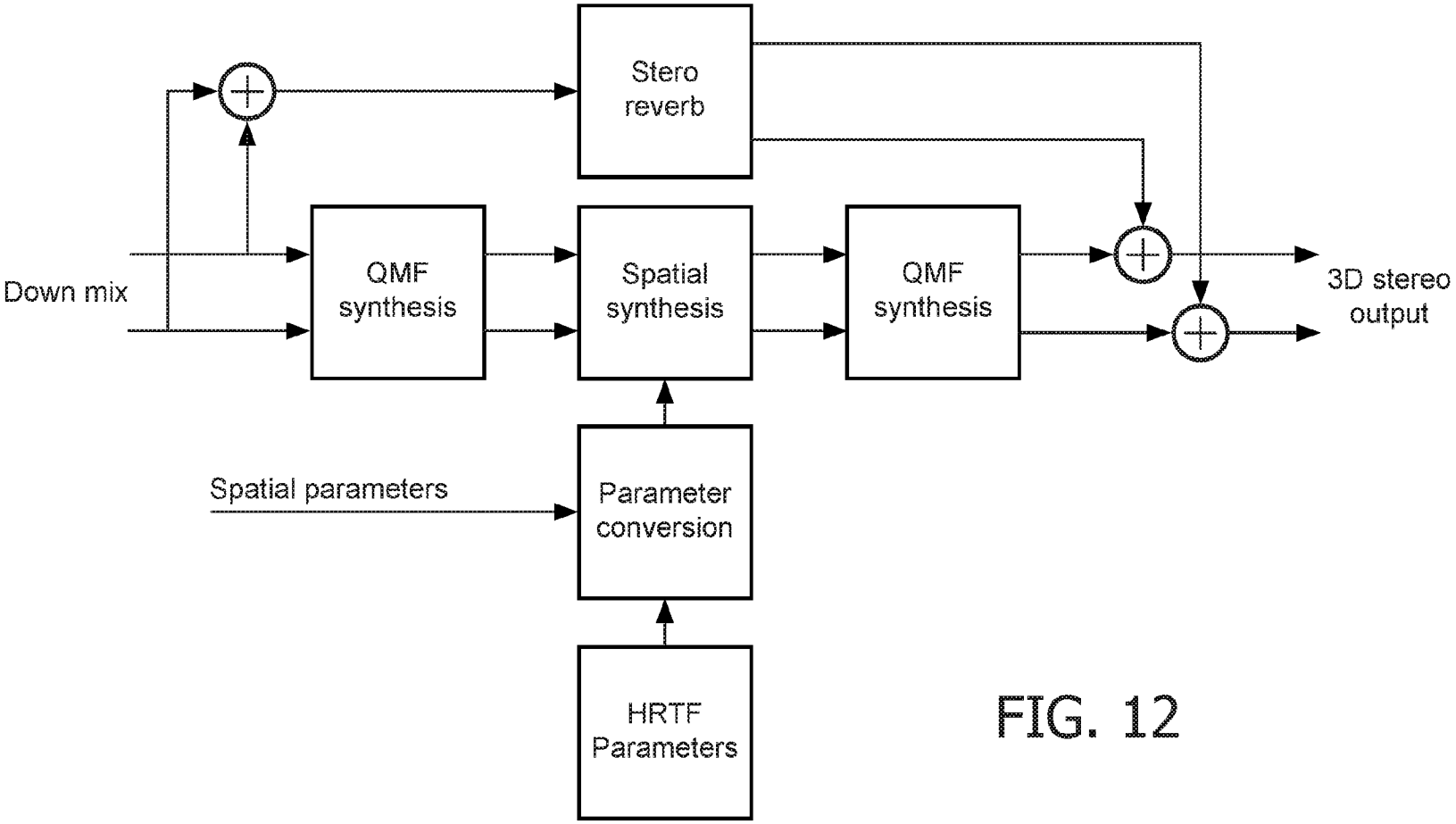
FIG. 12 illustrates an example of elements of an MPEG Surround system.

FIG. 12 illustrates an example of how reverberation may be added to signals in accordance with the MPEG Surround standard. The current standard allows only support for parameterized rendering of binaural signals, and therefore no long binaural filters can be used in the binaural rendering. The standard however provides an informative annex describing a structure to add reverb to MPEG Surround in binaural rendering mode as shown in FIG. 12. The described approach is compatible with this approach and accordingly allows for an efficient and improved audio experience to be provided for an MPEG Surround system.

Figure 13:
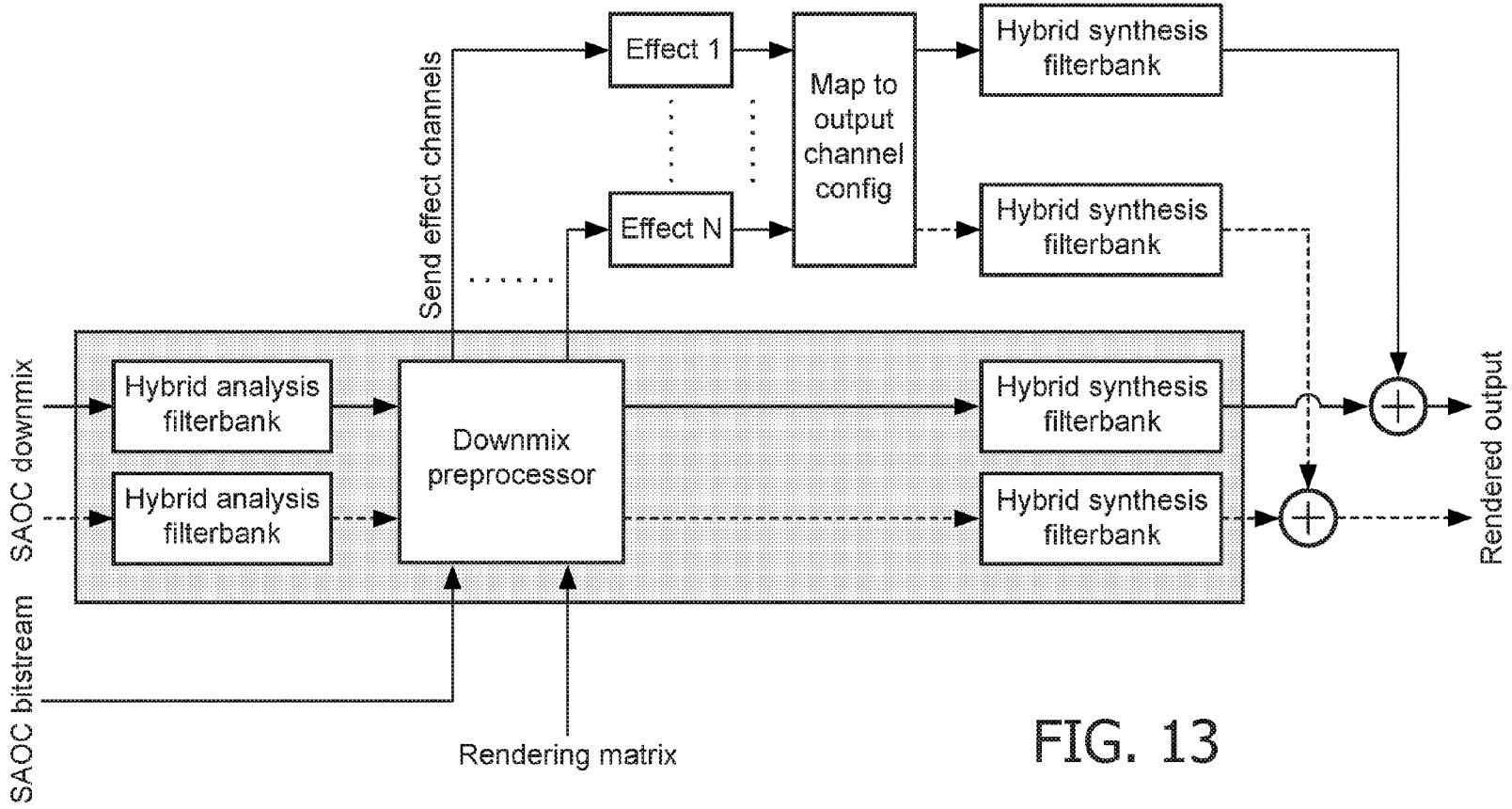
FIG. 13 illustrates an example of elements of an MPEG SAOC audio rendering system.

Similarly, the approach may also be used with SAOC. However, SAOC does not directly include any reverberation processing but does support an effects interface that can be used to perform a parallel binaural reverberation similar to MPEG Surround. FIG. 13 shows an example of how the SAOC effects interface is used to implement so called send-effects. For a binaural reverb the effects interface can be configured to output a send-effect channel containing all objects with relative gains similar to the binaural rendering that can be derived from the rendering matrix. Using the reverb as an effect module, a binaural reverb can be generated. In the case of a time-domain reverb, such as the Jot reverberator, the send effect channel can be transformed to the time domain by means of a hybrid synthesis filter-bank prior to applying the reverb.

The previous description focused on embodiments wherein the head related binaural transfer function was divided into two parts with one corresponding to the anechoic part and the other to the reflected part. Thus, in the examples, all the early reflections were part of the reverberation part of the head related binaural transfer function. However, in other embodiments, one or more of the early reflections may be included in the early part rather than in the reverberation part.

For example, for the BRIR of FIG. 7, the time instant dividing the early part and the reverberation part may be selected to be at 600 samples rather than at 500 samples. This will result in the early part including the first reflection.

Also, in some embodiments, the head related binaural transfer function may be divided into more than two parts. Specifically, the head related binaural transfer function may be divided into (at least) an early part which includes the anechoic part, the reverberation part which includes the diffuse reverberation tail, and (at least) one early reflection part which includes one or more of the early reflections.

In such an embodiment, the bitstream may accordingly be generated to comprise early part data indicative of the early and specifically the anechoic part of the head related binaural transfer function, early reflection part data indicative of the early reflection part of the head related binaural transfer function, and reverberation data indicative of the reverberation part of the head related binaural transfer function. Furthermore, the bitstream may in addition to the first synchronization indication which is indicative of a time offset between the early part and the reverberation part also include a second synchronization indication which is indicative of a time offset between early reflection part and at least one of the early part and the reverberation part.

The approaches described previously for dividing the head related binaural transfer function into two parts may also be used to derive the head related binaural transfer function into three parts. For example, a first section corresponding to the anechoic part may be detected by detecting a first signal sequence in a limited time interval, and a second section corresponding to the early reflection may be detected by detecting a second sequence in a time interval following the first interval. The time intervals of the first and second parts may e.g. be determined in response to a signal level, i.e. each interval may be selected to end when the amplitude falls below a given level (e.g. relative to a maximum level). The remaining part after the second time interval/early reflection part may be selected as the reverberation part.

The time offsets indicated by the synchronization indication may be found from the identified time intervals, or e.g. as time offsets found in response to a delay resulting in a maximization of a correlation between the signals in the different time intervals.

In such an approach, the receiver/rendering device may include three parallel paths, one for the early part, one for the early reflection part and one for the reverberation part. The processing for the early part may for example be based on a first FIR filter (represented by the early part data), the processing of the early reflection part may be based on a second FIR filter (represented by the early reflection part data), and the reverberation processing may be by a synthetic reverberator based on a reverberation model for which parameters are provided in the reverberation part data.

In this approach, three audio components are accordingly generated by three different processes, and these three audio components are then combined.

Furthermore, in order to provide temporal alignment, at least two of the paths—typically the early reflection path and the reverberation path—may include variable delays which are set in response to respectively the first and second synchronization indications. Thus, the delays are set based on the synchronization indications such that the combined effects of the three processes correspond to the full head related binaural transfer function.

Figure 14:
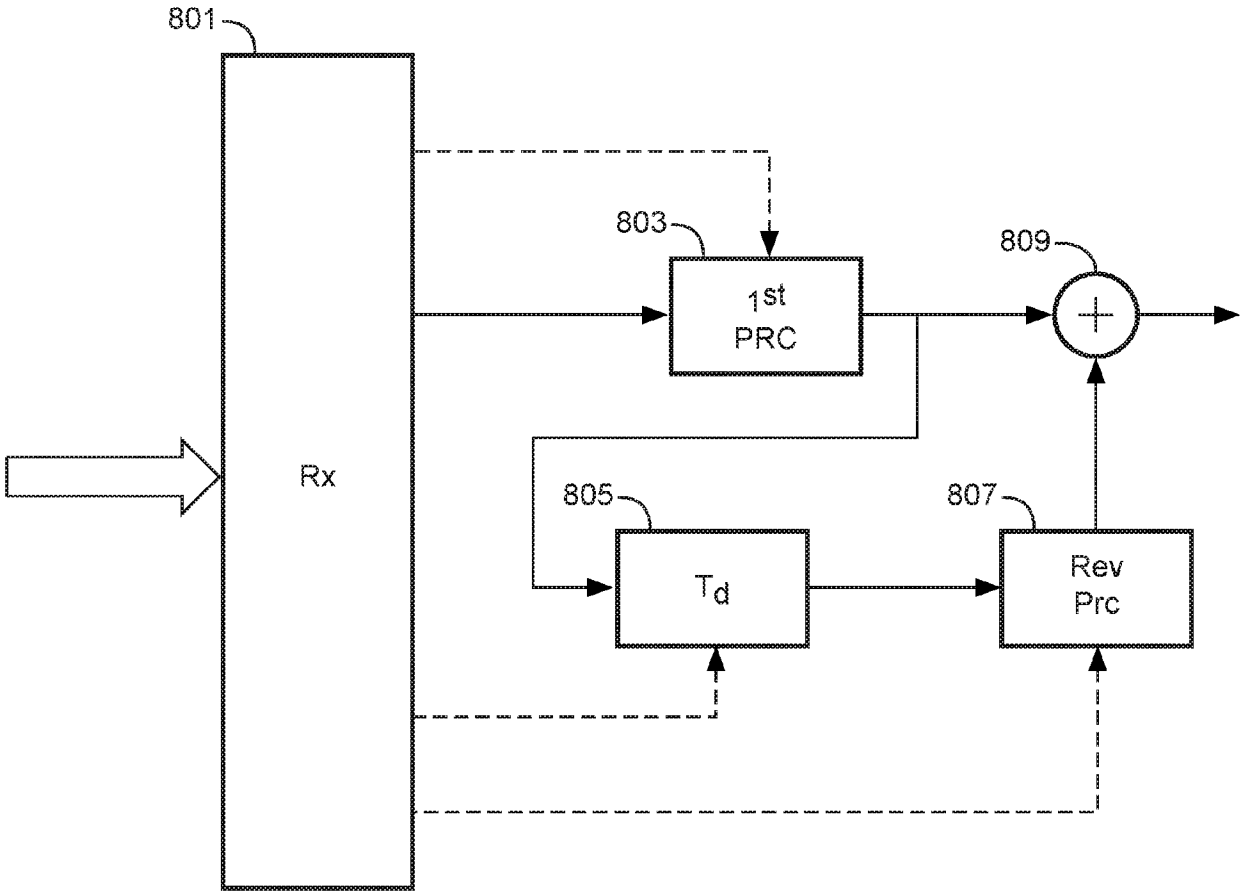
FIG. 14 illustrates an example of a binaural renderer in accordance with some embodiments of the invention.

In some embodiments, the processes may not be fully parallel. For example, rather than the reverberation process being based on the input audio signal as illustrated in FIG. 8, it may be based on applying a reverberation process to the audio component generated by the early part processor 803. An example of such an arrangement is shown in FIG. 14.

In this example, the delay 805 is still used to time align the early part signal and the reverberation signal, and it is set based on the received synchronization indication. However, the delay is set differently than in the system of FIG. 8 as the delay of the early part processor 803 is now also part of the reverberation processing. The delay may for example be set as:

$$T_d = T_o - T_r$$

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An apparatus for processing an audio signal, the apparatus comprising:

a receiver configured to receive input data, the input data comprising at least data describing a head related binaural transfer function comprising separately each of an early part and a reverberation part, the data comprising:

early part data indicative of the early part of the head related binaural transfer function, reverberation data indicative of the reverberation part of the head related binaural transfer function, separate and independent of the early part data, a synchronization indication indicative of a time offset between the early part and the reverberation part, separate and independent from the early part data and the reverberation data;

an early part circuit configured to generate a first audio component by applying a binaural processing to an audio signal, the binaural processing being at least partly determined by the early part data;

a reverberator configured separate from the early part circuit to generate a second audio component by applying a reverberation processing to the audio signal, the reverberation processing being at least partly determined by the reverberation data;

a combiner configured to generate at least a first ear signal of a binaural signal, the combiner being arranged to combine the first audio component and the second audio component; and a synchronizer configured to synchronize the first audio component and the second audio component in response to the synchronization indication.

2. The apparatus of claim 1 wherein the synchronizer is arranged to introduce a delay for the second audio component relative to the first audio component, the delay being dependent on the synchronization indication.

3. The apparatus of claim 1 wherein the early part data is indicative of an anechoic part of the head related binaural transfer function.

4. The apparatus of claim 1 wherein the early part data comprises frequency domain filter parameters, and an early part processing is a frequency domain processing.

5. The apparatus of claim 1 wherein the reverberation data comprises parameters for a reverberation model, and the reverberator is arranged to implement the reverberation model using parameters indicated by the reverberation part data.

6. The apparatus of claim 1 wherein the reverberator comprises a synthetic reverberator, and the reverberation data comprises parameters for the synthetic reverberator.

7. The apparatus of claim 1 wherein the reverberator comprises a reverberation filter, and the reverberation data comprises parameters for the reverberation filter.

8. The apparatus of claim 1 wherein the head related binaural transfer function further comprises an early reflection part separate and between the early part and the reverberation part; and the data further comprises:

early reflection part data indicative of the early reflection part of the head related binaural transfer function; and a second synchronization indication indicative of a time offset between the early reflection part and at least one of the early part and the reverberation part;

and the apparatus further comprises:

an early reflection part processor separate from the early part circuit and the reverberator for generating a third audio component by applying a reflection processing to the audio signal, the reflection processing being at least partly determined by the early reflection part data;

and the combiner is arranged to generate the first ear signal of the binaural signal in response to a combination of at least the first audio component, the second audio component, and the third audio component;

and the synchronizer is arranged to synchronize the third audio component with at least one of the first audio component and the second audio component in response to the second synchronization indication.

9. The apparatus of claim 1 wherein the reverberator is arranged to generate the second audio component in response to a reverberation process applied to the first audio component.

10. The apparatus of claim 1 wherein the synchronization indication is compensated for a processing delay of the binaural processing.

11. The apparatus of claim 1 wherein the synchronization indication is compensated for a processing delay of the reverberation processing.

12. An apparatus for generating a bitstream, the apparatus comprising:

a processor configured to receive a head related binaural transfer function comprising separately each of an early part and a reverberation part;

an early part circuit configured to generate early part data indicative of the early part of the head related binaural transfer function;

a reverberation circuit configured separate from the early part circuit to generate reverberation data indicative of the reverberation part of the head related binaural transfer function;

a synchronization circuit configured to generate synchronization data separate and independent from the early part data and the reverberation data, the synchronization data comprising a synchronization indication indicative of a time offset between the early part data and the reverberation data; and an output circuit configured to generate a bitstream comprising the early part data, the reverberation data and the synchronization data.

13. A method of operating apparatus for processing an audio signal, the method comprising: In apparatus for processing an audio signal:

receiving input data via a receiver, the input data comprising at least data describing a head related binaural transfer function comprising separately each of an early part and a reverberation part, the data comprising:

early part data indicative of the early part of the head related binaural transfer function, reverberation data separate from the early part data and indicative of the reverberation part of the head related binaural transfer function, a synchronization indication separate and independent from the early part data and the reverberation data, the synchronization data indication indicative of a time offset between the early part and the reverberation part;

generating a first audio component in an early part circuit, by applying a binaural processing to an audio signal, the binaural processing being at least partly determined by the early part data;

generating a second audio component in a reverberator by applying a reverberation processing to the audio signal, the reverberation processing being at least partly determined by the reverberation data;

generating at least a first ear signal of a binaural signal in a combiner, in response to a combination of the first audio component and the second audio component; and synchronizing the first audio component and the second audio component in a synchronizer, in response to the synchronization indication.

14. A method of operating apparatus for generating a bitstream, the method comprising:

in an apparatus for processing an audio signal:

receiving in a processor, a head related binaural transfer function comprising separately each of an early part and a reverberation part;

generating in an early part circuit, early part data indicative of the early part of the head related binaural transfer function;

generating in a reverberator separate from the early part circuit, reverberation data indicative of the reverberation part of the head related binaural transfer function;

generating in a synchronizer, synchronization data separate and independent from the early part data and the reverberation data, the synchronization data comprising a synchronization indication indicative of a time offset between the early part data and the reverberation data; and generating in an output circuit, a bitstream comprising the early part data, the reverberation data, and the synchronization data.

15. A computer-readable storage-medium that is not a propagating wave or signal, comprising computer program configured to perform a method of operating apparatus for processing an audio signal, the method comprising, the method of claim 13.

16. A computer-readable storage-medium that is not a propagating wave or signal, comprising data representing a head related binaural transfer function comprising an early part and a reverberation part, the data comprising:

early part data indicative of the early part of the head related binaural transfer function;

reverberation data separate from the early part data and indicative of the reverberation part of the head related binaural transfer function;

synchronization data separate and independent from the early part data and the reverberation data, the synchronization data indication comprising a synchronization indication indicative of a time offset between the early part data and the reverberation data.

17. A computer-readable storage-medium that is not a propagating wave or signal, comprising computer program code configured to perform a method of operating apparatus for processing an audio signal, the method comprising, the method of claim 14.

* * * * *